US008095060B2

(12) United States Patent
Kiuchi et al.

(10) Patent No.: US 8,095,060 B2
(45) Date of Patent: Jan. 10, 2012

(54) CLEANING DEVICE AND IMAGE FORMING APPARATUS

(75) Inventors: Yutaka Kiuchi, Kanagawa (JP); Satoshi Shigezaki, Kanagawa (JP); Satoya Sugiura, Kanagawa (JP); Ayumi Noguchi, Kanagawa (JP); Takayuki Yamashita, Kanagawa (JP); Mitsuo Yamamoto, Kanagawa (JP); Masaya Nakatsuhara, Kanagawa (JP); Yuki Nagamori, Kanagawa (JP); Mikio Yamaguchi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 562 days.

(21) Appl. No.: 12/174,492

(22) Filed: Jul. 16, 2008

(65) Prior Publication Data

US 2009/0097893 A1 Apr. 16, 2009

(30) Foreign Application Priority Data

Oct. 15, 2007 (JP) ..... 2007-267633

(51) Int. Cl.
*G03G 21/00* (2006.01)

(52) U.S. Cl. ..... 399/350; 399/358

(58) Field of Classification Search ..... 399/350, 399/358

See application file for complete search history.

(56) References Cited

U.S. PATENT DOCUMENTS

| | | | | |
|---|---|---|---|---|
| 4,442,790 | A * | 4/1984 | Swapceinski et al. | 399/269 |
| 4,577,587 | A | 3/1986 | Kamezaki | 118/658 |
| 2001/0008591 | A1 | 7/2001 | Kaneshige et al. | 399/258 |
| 2003/0152407 | A1 * | 8/2003 | Hatano | 399/350 |
| 2005/0214045 | A1 | 9/2005 | Ohta et al. | 399/350 |
| 2006/0024100 | A1 * | 2/2006 | Ohta et al. | 399/350 |
| 2006/0204297 | A1 * | 9/2006 | Honda et al. | 399/349 |
| 2006/0257175 | A1 | 11/2006 | Endo et al. | 399/281 |
| 2007/0003337 | A1 * | 1/2007 | Shakuto et al. | 399/349 |
| 2007/0217843 | A1 | 9/2007 | Ichikawa et al. | 399/350 |

FOREIGN PATENT DOCUMENTS

| | | | |
|---|---|---|---|
| JP | 60-184067 | | 12/1985 |
| JP | 61-103177 | | 5/1986 |
| JP | 61103177 | A * | 5/1986 |
| JP | 1-150180 | | 6/1989 |
| JP | 06-118787 | | 4/1994 |

(Continued)

OTHER PUBLICATIONS

IDS Documents.*

*Primary Examiner* — David Gray
*Assistant Examiner* — David Bolduc
(74) *Attorney, Agent, or Firm* — Morgan, Lewis & Bockius LLP

(57) ABSTRACT

A cleaning device includes a cleaning blade that contacts an image carrier and cleans residual toner remaining on the image carrier; a toner pool forming member that is disposed on an upstream side of the cleaning blade in a rotational direction of the image carrier, collects the residual toner that has been cleaned, and forms a toner pool that contacts the cleaning blade and the image carrier; and a toner amount adjusting component that makes the pressure of the residual toner that acts on the image carrier substantially uniform across an axis-of-rotation direction of the image carrier by adjusting the amount of the residual toner in the toner pool in the axis-of-rotation direction of the image carrier.

21 Claims, 18 Drawing Sheets

FOREIGN PATENT DOCUMENTS

| | | | |
|---|---|---|---|
| JP | 11-161125 | | 6/1999 |
| JP | 11161125 | A * | 6/1999 |
| JP | 2001-075445 | | 3/2001 |
| JP | 2001-194882 | | 7/2001 |
| JP | 2002-049288 | | 2/2002 |
| JP | 3695496 | | 7/2005 |
| JP | 2005-309404 | | 11/2005 |
| JP | 2006-010957 | | 1/2006 |
| JP | 2006-030730 | | 2/2006 |
| JP | 2006-194938 | | 7/2006 |
| JP | 2006-259466 | | 9/2006 |
| JP | 2006-317718 | | 11/2006 |
| JP | 2006-337588 | | 12/2006 |
| JP | 2007-139927 | | 6/2007 |
| JP | 2007-171677 | | 7/2007 |
| JP | 2007-248646 | | 9/2007 |

* cited by examiner

FIG. 18

○ : NO PROBLEMS
△ : ACCEPTABLE LEVEL
× : UNACCEPTABLE LEVEL

| | | 100Kpv | 200Kpv | 300Kpv | 400Kpv |
|---|---|---|---|---|---|
| EXAMPLE | HIGH TEMPERATURE HIGH HUMIDITY | ○ | ○ | ○ | ○ |
| | LOW TEMPERATURE LOW HUMIDITY | ○ | ○ | ○ | ○ |
| COMPARATIVE EXAMPLE | HIGH TEMPERATURE HIGH HUMIDITY | × | × | × | × |
| | LOW TEMPERATURE LOW HUMIDITY | ○ | ○ | △ | × |

CLEANING DEVICE AND IMAGE FORMING APPARATUS

CROSS-REFERENCE TO RELATED APPLICATION

This application is based on and claims priority under 35 USC 119 from Japanese Patent Application No. 2007-267633 filed on Oct. 15, 2007.

BACKGROUND

1. Technical Field

The present invention relates to a cleaning device that removes residual toner remaining on an image holder and to an image forming apparatus that uses this cleaning device.

2. Related Art

Image forming apparatus that transfer a toner image that has been formed on an image holder such as a photoreceptor drum to a medium such as paper are known. For example, in common electrophotographic image forming apparatus represented by copiers and laser printers, an image is formed by a charging step, an exposing step, a developing step, a transferring step and a fixing step, and transfer residual toner (below, simply called "residual toner") remaining on the image holder in the transfer step is removed in a cleaning step.

As a cleaning device that is used in the cleaning step, a system that uses a blade to clean and remove the residual toner remaining on the image holder is known.

SUMMARY

A cleaning device of a first aspect of the present invention comprises a cleaning blade that contacts an image carrier and cleans residual toner remaining on the image carrier; a toner pool forming member that is disposed on an upstream side of the cleaning blade in a rotational direction of the image carrier, collects the residual toner that has been cleaned, and forms a toner pool that contacts the cleaning blade and the image carrier; and a toner amount adjusting component that makes the pressure of the residual toner that acts on the image carrier substantially uniform across an axis-of-rotation direction of the image carrier by adjusting the amount of the residual toner in the toner pool in the axis-of-rotation direction of the image carrier.

BRIEF DESCRIPTION OF THE DRAWINGS

Exemplary embodiments of the present invention will be described in detail based on the following figures, wherein:

FIG. 18 is a chart showing image quality evaluations; and

DESCRIPTION

Below, exemplary embodiments of a cleaning device according to the present invention and an image forming apparatus that uses this cleaning device will be described on the basis of the drawings.

First Exemplary Embodiment

Figure 1:
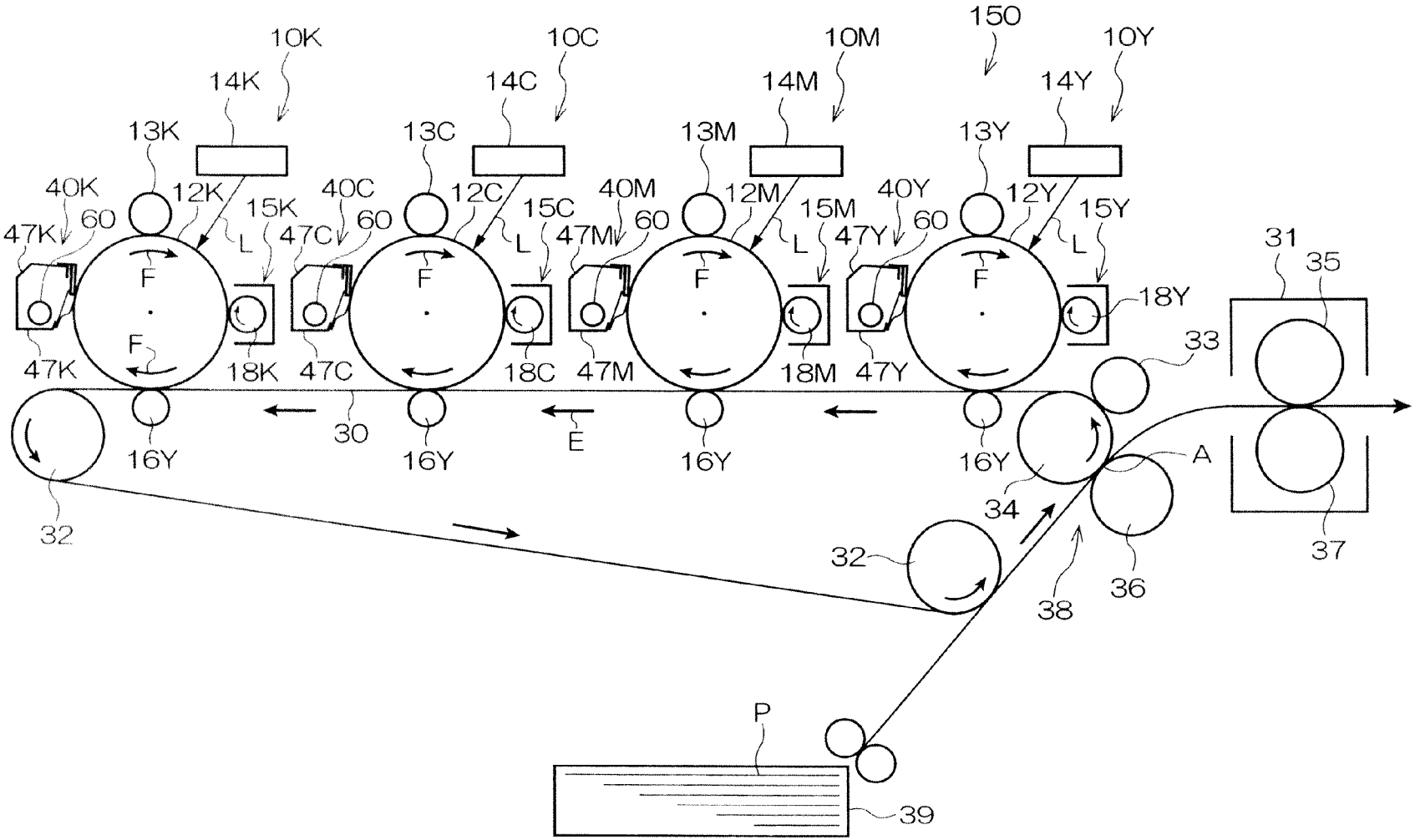
FIG. 1 is a general configural diagram showing an image forming apparatus according to the exemplary embodiments of the present invention.

In FIG. 1, there is generally showing the configuration of an image forming apparatus 150. In the image forming apparatus 150, there is disposed an endless belt-like intermediate transfer belt 30 (an example of an intermediate transfer member) that is stretched around plural rollers 32 and is conveyed in the direction of arrows E by the driving of a motor (not shown). Plural image forming units 10 (the details of which will be described later) are disposed along the conveyance direction E of the intermediate transfer belt 30.

The image forming units 10 in the present exemplary embodiment conducts color images formation and includes image forming units 10Y, 10M, 10C and 10K that form toner images that correspond to the four colors of yellow (Y), magenta (M), cyan (C) and black (K). When it is necessary to distinguish between the colors of yellow, magenta, cyan and black in the reference numerals below, the letters Y, M, C and K will be added after the reference numerals, and when it is not necessary to distinguish between the colors of yellow, magenta, cyan, and black, the letters Y, M, C and K will be omitted.

Each of the image forming units 10 (it will be noted that, because the configuration of each of the image forming units 10 is the same, here, the image forming units 10 will be described with the letters representing each of the colors being omitted) is disposed with a photoreceptor drum 12 that serves as an example of an image carrier that rotates at a predetermined speed in the direction of arrows F and is disposed so as to contact the intermediate transfer belt 30.

Charge rolls 13 for charging the photoreceptor drums 12 are disposed on the peripheries of the photoreceptor drums 12. The charge rolls 13 are electrically conductive rollers, are disposed such that their outer peripheral surfaces contact the surfaces of the photoreceptor drums 12, rotate so as to follow the rotation of the photoreceptor drums 12, and uniformly charge the surfaces of the photoreceptor drums 12 to a predetermined electric potential.

Exposure devices 14 are disposed on the downstream side of the charge rolls 13 in the rotational direction F of the photoreceptor drums 12. Each of the exposure devices 14 of the present exemplary embodiment is configured by an LED (light-emitting diode) array comprising an array of plural light-emitting diodes. The exposure devices 14 modulate light beams L on the basis of image data and irradiate the photoreceptor drums 12 that have been uniformly charged by the charge rolls 13 with the modulated light beams L. Thus, electrostatic latent images are formed on the photoreceptor drums 12.

Further, developing devices 18 are disposed on the downstream side of the exposure devices 14 in the rotational direction F of the photoreceptor drums 12. Toner is supplied to the photoreceptor drums 12 from the developing devices 18, the electrostatic latent images that have been formed on the photoreceptor drums 12 are developed, and toner images are formed. External additive (fine particles) disposed with lubricating action and polishing action are added to the toner. Further, in the present exemplary embodiment, pulverized toner whose toner particles are irregular is used.

Moreover, transfer rolls 16 are disposed on the downstream side of the developing devices 18 in the rotational direction F of the photoreceptor drums 12. A voltage of the opposite polarity of the charge of the toner is applied to the transfer rolls 16 to cause the toner on the photoreceptor drums 12 to be transferred onto the intermediate transfer belt 30.

The toner images of mutually different colors that have been formed by the image forming units 10 are respectively transferred onto the intermediate transfer belt 30 such that the toner images are mutually superposed. Thus, a color toner image is formed on the intermediate transfer belt 30.

Here, cleaning devices 40 that are provided with blades 42 are disposed on the downstream side of the transfer rolls 16 in the rotational direction F of the photoreceptor drums 12. Later-described corner portions 42C of the blades 42 contact the surfaces of the photoreceptor drums 12, whereby residual toner T that did not be transferred to the intermediate transfer belt 30 by the transfer rolls 16 and remains on the photoreceptor drums 12 is cleaned from (removed from) the surfaces of the photoreceptor drums 12.

A transfer device 38 that serves as an example of a second transfer unit and comprises two opposing rollers 34 and 36 is disposed on the downstream side of the four image forming units 10 in the conveyance direction E of the intermediate transfer belt 30. The toner image that has been formed on the intermediate transfer belt 30 is fed between the rollers 34 and 36. Then, the toner image on the intermediate transfer belt 30 is transferred to paper P that serves as a medium that has been conveyed between the rollers 34 and 36 from a paper tray 39 disposed in the image forming apparatus 150.

A fixing device 31 that serves as an example of a fixing unit and comprises a heat roller 35 and a pressure roller 37 is disposed on the conveyance path of the paper P. The paper P that has been conveyed to the fixing device 31 is nipped between and conveyed by the heat roller 35 and the pressure roller 37, whereby the toner on the paper P melts and is fixed to the paper P. Thus, a desired image is formed on the paper P. The paper P on which the image has been formed is discharged to the outside of the image forming apparatus 150.

A cleaning device 33 for the intermediate transfer belt is disposed on the intermediate transfer belt 30, and transfer residual toner that was not transferred to the paper P by the transfer device 38 and remains on the intermediate transfer belt 30 is recovered by the intermediate transfer belt-use cleaning device 33.

(Cleaning Device)

Figure 2:
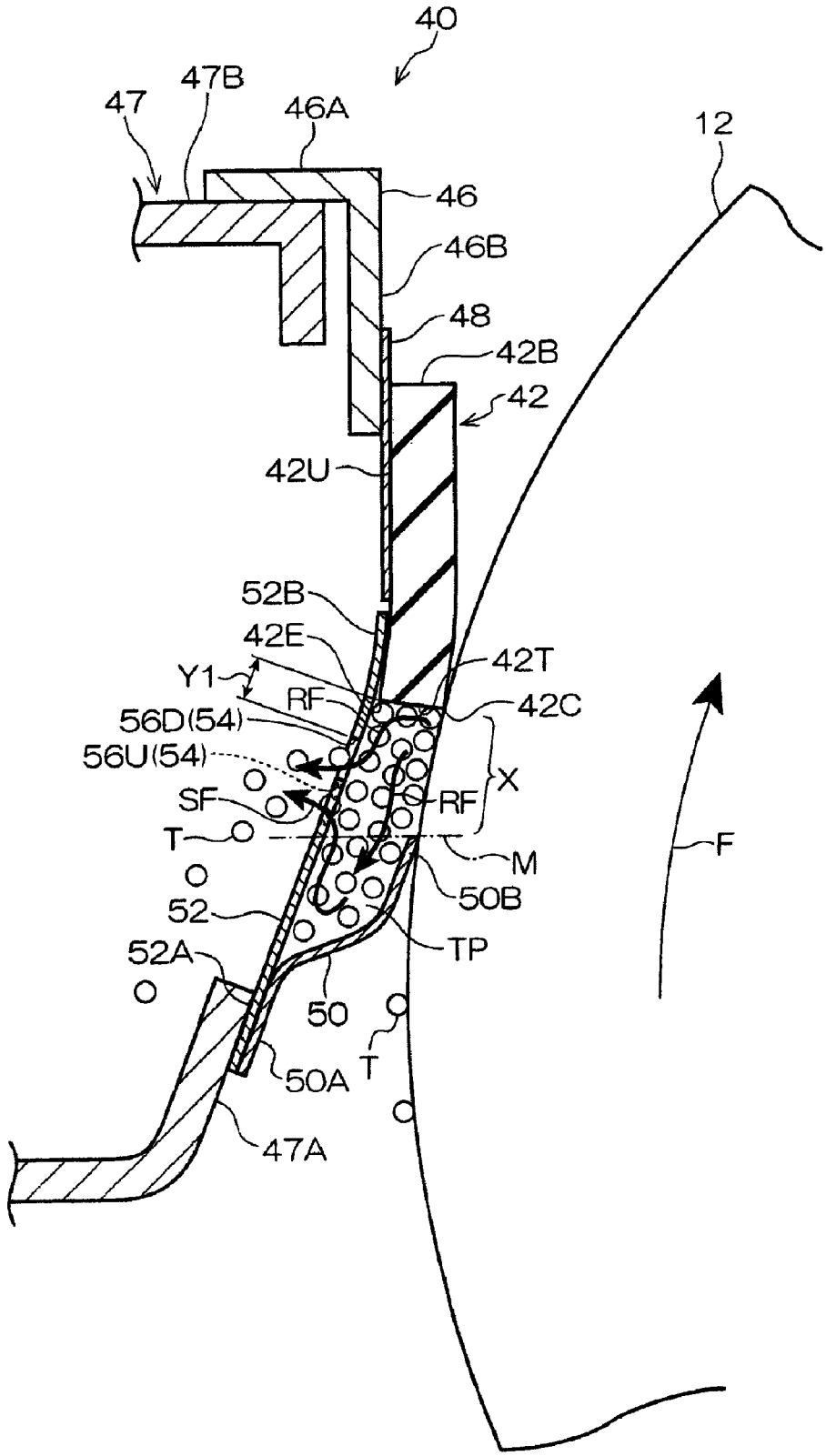
FIG. 2 is a partially enlarged cross-sectional diagram of a cleaning device that is used in the image forming apparatus and according to a first exemplary embodiment of the present invention.

Next, the cleaning device 40 will be described in detail. FIG. 2 is an enlarged diagram of relevant portions of the cleaning device 40.

As shown in FIG. 2, the cleaning device 40 is disposed with a box-like housing 47. The housing 47 includes an opening in its wall surface on the side that faces the surface of the photoreceptor drum 12. A toner pool sheet 52 that serves as an example of a toner pool forming member and a lower seal 50 that serves as an example of a toner pool forming member are fixed to a lower edge portion 47A of this opening (the edge portion on the upstream side in the rotational direction F of the photoreceptor drum 12). A blade 42 is fixed to an upper wall surface 47B of the housing 47 (the wall surface on the downstream side in the rotational direction F of the photoreceptor drum 12) via a fixing bracket 46 and a blade plate 48.

The blade 42 is one where urethane rubber, which serves as an example of a resin material, is formed as a plate body (in the present exemplary embodiment, a substantially rectangular parallelepiped shape), and a corner portion 42C of the tip portion of the blade 42 contacts the surface of the photoreceptor drum 12.

The width (length along an axis-of-rotation direction K of the photoreceptor drum 12) of the blade 42 is set to be equal to or greater than the width (length along the axis-of-rotation direction K of the photoreceptor drum 12) of a toner image forming region on the surface of the photoreceptor drum 12. For this reason, the residual toner T remaining on the entire surface of the photoreceptor drum 12 can be cleaned by the blade 42. Further, in the present exemplary embodiment, the material of the blade 42 is urethane rubber, but another material (e.g., isoprene rubber, chloroprene rubber, etc.) may also be used. Further, the blade 42 is a plate body (a substantially rectangular parallelepiped shape), but as long as the blade 42 is a plate body, the blade 42 may also have a shape where the tip portion is tapered or a shape that has a curved portion.

A base end portion 42B side of a rear surface 42U of the blade 42 is joined to one end side of the plate-like blade plate 48. The other end side of the blade plate 48 is fixed to one piece 46B of the fixing bracket 46 whose cross-sectional shape is L-shaped. It will be noted that the method of fixing another piece 46A to the upper wall surface 47B is not particularly limited, but it is preferable to use screws. The reason for this is because it becomes easier to position the blade 42 when screws are utilized to adjust the fixing position of the fixing bracket 46. It will be noted that the blade plate 48 is an example of a reinforcement plate and extends as far as the vicinity of the tip portion of the blade 42.

As shown in FIG. 2, the lower seal 50 and the toner pool sheet 52 are fixed to the lower edge portion 47A such that one end portion 50A of the lower seal 50 and one end portion 52A of the toner pool sheet 52 are superposed. The lower seal 50 is disposed closer to the photoreceptor drum 12 than the toner pool sheet 52, and another end portion 50B of the lower seal 50 contacts the surface of the photoreceptor drum 12. Further, another end portion 52B of the toner pool sheet 52 contacts the rear surface 42U of the blade 42.

Here, a toner pool region for collecting the residual toner T is defined by the surface of the photoreceptor drum 12, an end surface 42T of the tip portion of the blade 42, the lower seal 50 and the toner pool sheet 52. Additionally, the residual toner T is collected in this toner pool region, whereby a toner pool TP that contacts the surface of the photoreceptor drum 12 and the end surface 42T of the tip portion of the blade 42 is formed.

It will be noted that the widths (lengths along the axis-of-rotation direction K of the photoreceptor drum 12) of the lower seal 50 and the toner pool sheet 52 are set to be equal to or greater than the width of the blade 42. For this reason, the residual toner T that has been cleaned from the surface of the photoreceptor drum 12 by the corner portion 42C of the tip portion of the blade 42 is reliably collected in the toner pool region.

Further, unillustrated side seals are disposed on both end sides of the blade 42 in the axis-of-rotation direction K. The side seals are fixed to side plates of the housing 47 and can prevent the residual toner T that has been cleaned by the blade 42 and collected in the toner pool region from leaking from the axis-of-rotation direction K.

Figure 3A:
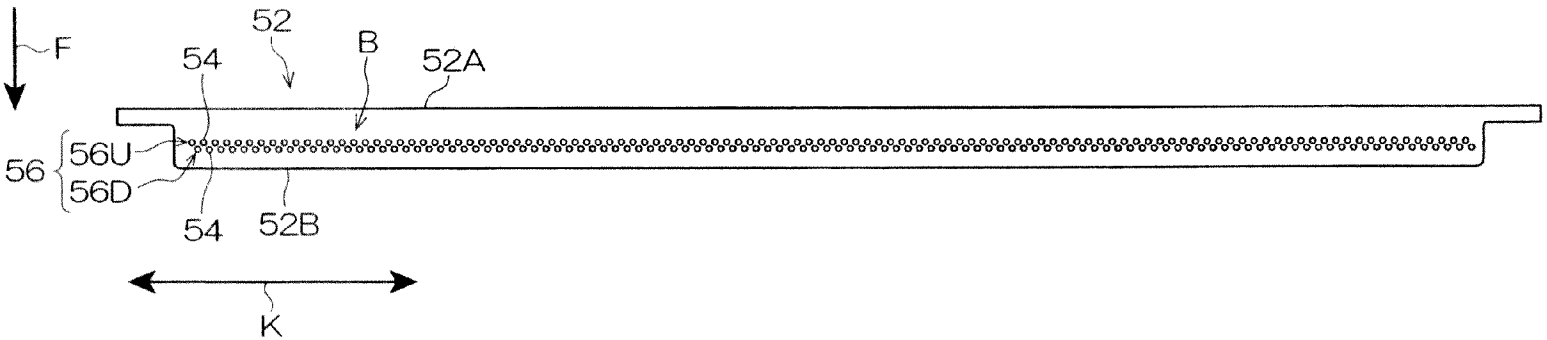
FIG. 3A is a front diagram showing a blade of the cleaning device according to the first exemplary embodiment of the present invention.

As shown in FIG. 2 and FIG. 3A, plural openings 54 that discharge the residual toner T in the toner pool TP to the inside of the housing 47 are disposed in the toner pool sheet 52. In the present exemplary embodiment, the openings 54 are configured as circular holes. It will be noted that the openings 54 may also have a shape other than a circular shape, such as a polygonal shape, an elliptical shape, or a shape that includes a curve in at least a portion thereof.

Figure 3B:
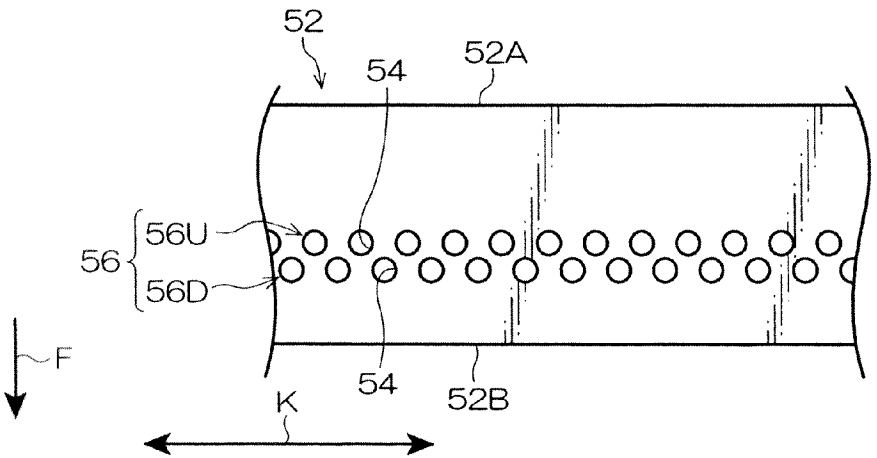
FIG. 3B is an enlarged diagram of portion B in FIG. 3A.

As shown in FIG. 3B, the openings 54 are disposed so as to be provided on any line that intersects (is orthogonal to) the axis-of-rotation direction K of the photoreceptor drum 12 inside the toner image forming region. In other word, each region of the toner image forming region of the photoreceptor drum 12 passes over at least one of the openings 54.

It will be noted that, in the present exemplary embodiment, the plural openings are disposed along the axis-of-rotation direction K, plural (two) rows of the openings 56 are formed, and adjacent rows 56 are disposed so as to be offset in the axis-of-rotation direction K each other. In other words, the openings 54 are disposed in a staggered manner. Further, of these two rows 56, the row 56 on the upstream side in the rotational direction F of the photoreceptor drum 12 (or, when there are three or more rows of the openings, the row on the most upstream side) will, for the sake of explanation convenience, be called an opening row 56U, and the row on the downstream side in the rotational direction F (or, when there are three or more rows of the openings, the opening row on the most downstream side) will, for the sake of explanation convenience, be called an opening row 56D. Further, at least some of the openings 54 in the opening row 56U are disposed further to the downstream side in the rotational direction of the photoreceptor drum 12 than a normal line M that extends from an end of a contact region X where the surface of the photoreceptor drum 12 and the toner pool TP contact each other. Note that the end of the contact region X is on the upstream side in the rotational direction F, Further, it is preferable for the hole diameter of the openings 54 and a distance Y1 from a corner portion 42E of the tip portion of the blade 42 on the toner pool sheet 52 side to the edge portions of the openings 54 to have a relationship as in the chart shown in FIG. 19.

As shown in FIG. 1, augers 60 that extend in the longitudinal direction of the blades 42 (the axis-of-rotation direction K of the photoreceptor drums 12) are disposed in the lower portions of the insides of the housings 47. Because of these augers 60, the residual toner T that has been cleaned by the blades 42 is pushed toward one side of the housings 47 and discharged from unillustrated discharge openings. Waste toner that has been discharged is conveyed to residual toner collecting devices that are separately disposed.

Next, the action of the cleaning device 40 will be described. As shown in FIG. 2, the corner portion 42C of the tip portion of the blade 42 contacts the surface of the photoreceptor drum 12, and the residual toner T remaining on the surface of the photoreceptor drum 12 that rotates in the rotational direction F is cleaned by the corner portion 42C of the blade 42. The residual toner T that has been cleaned is collected in the toner pool region, and the toner pool TP that contacts the end surface 42T of the tip portion of the blade 42 and the surface of the photoreceptor drum 12 is formed. The residual toner T in the toner pool TP is discharged through the openings 54 to the inside of the housing 47 (toward the auger 60). The amount of the residual toner T in the toner pool TP in the axis-of-rotation direction K of the photoreceptor drum 12 is adjusted by the plural openings 54, and the pressure of the residual toner that acts on the photoreceptor drum 12 becomes uniform along the axis-of-rotation direction K of the photoreceptor drum 12. Thus, the ability to remove products caused by electrical discharge from the photoreceptor drum 12 is ensured and, as a result, the phenomenon of image deletion (phenomena such as image cracks and bleeding) on the surface of the photoreceptor drum 12, which occurs due to the products caused by electrical discharge and adhered to the surface of the photoreceptor drum 12 absorb moisture, is controlled. Further, because the pressure of the residual toner that acts on the photoreceptor drum 12 becomes uniform along the axis-of-rotation direction K of the photoreceptor drum 12, the occurrence of uneven wear in the photoreceptor drum 12 is controlled and the lifespan of the photoreceptor drum 12 is prolonged.

Further, because the residual toner T in the toner pool TP acts as a lubricant of the blade 42 (specifically, the external additive that has been added to the residual toner T intervene between the corner portion 42C of the blade 42 and the surface of the photoreceptor drum 12 and act as a lubricant), minute vibrations of the blade 42 are reduced, and noises when the blade 42 slides against the photoreceptor drum 12 and damage to the corner portion 42C of the blade 42 are prevented.

Further, because the openings 54 are provided on any line that intersects (is orthogonal to) the axis-of-rotation direction K of the photoreceptor drum 12 inside the toner image forming region, the residual toner T is discharged from the toner pool TP in any place inside the toner image forming region of the toner pool sheet 52. Thus, accumulation of the residual toner T in the toner pool TP in the axis-of-rotation direction K of the photoreceptor drum 12 is controlled.

Figure 4:
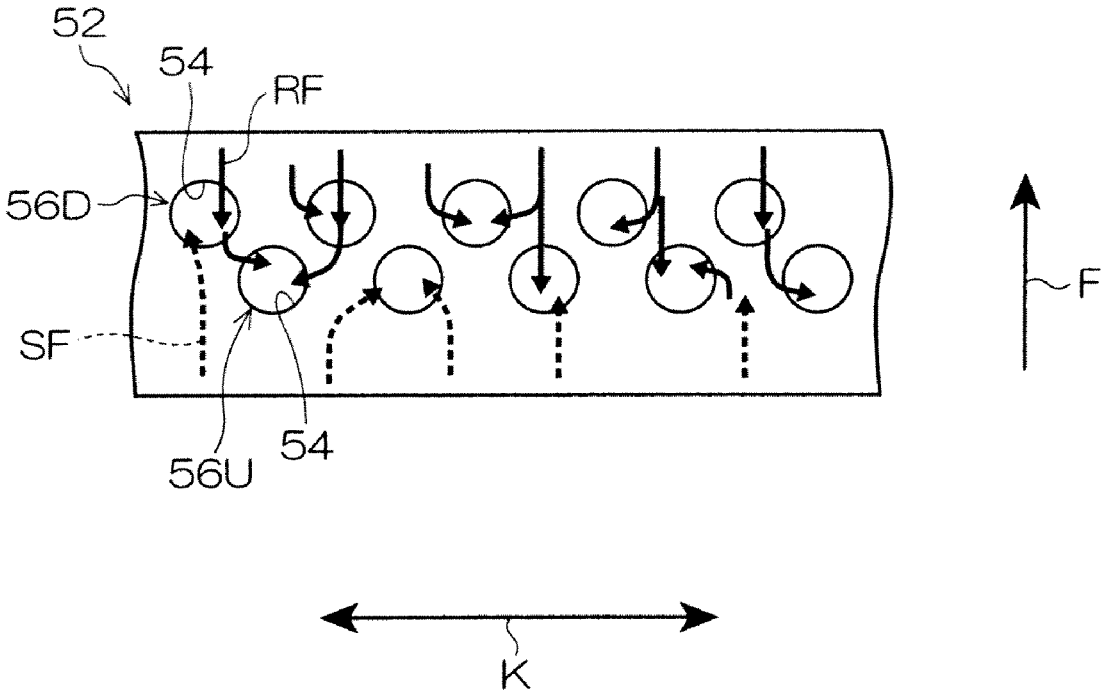
FIG. 4 is an explanatory diagram showing flows of residual toner that is discharged from plural openings in a toner pool sheet of the cleaning device according to the first exemplary embodiment of the present invention.

Further, as shown in FIG. 2, the residual toner T in the toner pool TP receives rotational force in the opposite direction of the rotational direction F because of the inflow of the residual toner T that has been cleaned by the blade 42 and frictional force in the contact region X where the toner pool TP and the photoreceptor drum 12 contact each other. Because of this rotational force in the opposite direction, a flow SF of the residual toner T in the same direction as the rotational direction F towards the two rows 56 and a flow RF of the residual toner T in the opposite direction of the rotational direction F arise in the toner pool TP. Here, as shown in FIG. 4, because the rows of the openings 56 that are adjacent to each other are offset in the axis-of-rotation direction K, these flows of the residual toner T interfere with each other in the vicinities of the rows 56, and turbulence arises in the flows of the residual toner T. The efficiency with which the residual toner T is discharged from the toner pool TP improves as a result of turbulence arising, so the amount of the residual toner T in the toner pool TP is adjusted.

Incidentally, sometimes the external additive that is added to the residual toner T escape the corner portion 42C of the blade 42 without being cleaned from the surface of the photoreceptor drum 12 by the corner portion 42C. The amount of the external additive that escapes is proportional to the amount of the residual toner T in the toner pool TP so when the difference in the amount of the residual toner T in the toner pool TP in the axis-of-rotation direction K is large, the difference in the amount of the external additive that escapes in the axis-of-rotation direction K also becomes large, accordingly. As it is susceptible for the external additive to adhere to the surface of the charge roll 13, when the difference in the amount of the external additive that escapes in the axis-of-rotation direction K is large, the difference in the amount of the external additive that adheres to the charge roll 13 in the axis-of-rotation direction K becomes large. At the portion of the charge roll 13 where the amount of the adhered external additive is large, sometimes charge defects occur in the photoreceptor drum 12 and image defects such as density unevenness occur. In contrast, in the present exemplary embodiment, differences in the amount of the residual toner T in the toner pool TP in the axis-of-rotation direction K can be made small, accordingly, differences in the amount of the external additive that escapes in the axis-of-rotation direction K can also be made small. Thus, the amount of the external additive that adheres to the charge roll 13 in the axis-of-rotation direction K becomes close to uniform, so the occurrence of image defects such as density unevenness is controlled.

Further, the flows of the residual toner T in the toner pool TP are strong on the end surface 42T side (the downstream side in the rotational direction F) of the tip portion of the blade 42 that cleans the residual toner T from the surface of the photoreceptor drum 12 and then become calm on the side away from the end surface 42T (the upstream side in the rotational direction F). For this reason, the closer the openings 54 disposed in the toner pool sheet 52 are to the end surface 42T of the blade 42, the easier it is for the residual toner T that has been cleaned to end up being discharged from the openings 54 before being collected in the toner pool TP and for a sufficient amount of the residual toner T to not be ensured in the toner pool TP. However, by configuring the cleaning device 40 such that at least some of the openings 54 in the opening row 56U are provided on the downstream side in the rotational direction F than the normal line M that extends from the end of the contact region X where the toner pool TP and the photoreceptor drum 12 contact each other, the end is on the upstream side in the rotational direction F, a sufficient amount of the residual toner T is ensured in the toner pool TP.

It will be noted that the residual toner T is effectively discharged from the toner pool TP by shortening the distance between both centerlines in the axis-of-rotation direction K that pass the centers of each of the openings 54 in the row 56U and the centers of each of the openings 54 in the opening row 56D. Thus, the efficiency with which the residual toner T in the toner pool TP is refreshed improves. It will be noted that, in shortening the distance between the centerline of the opening row 56U and the centerline of the opening 56D, for example, the openings 54 may be disposed so as to be provided on any line along the axis-of-rotation direction K of the photoreceptor drum 12 between the opening row 56U and the opening row 56D.

Second Exemplary Embodiment

Next, a cleaning device 70 according to a second exemplary embodiment of the present invention will be described on the basis of FIG. 5. It will be noted that the same reference numerals will be given to members that are the same as those in the first exemplary embodiment and that description of those same members will be omitted.

Figure 5:
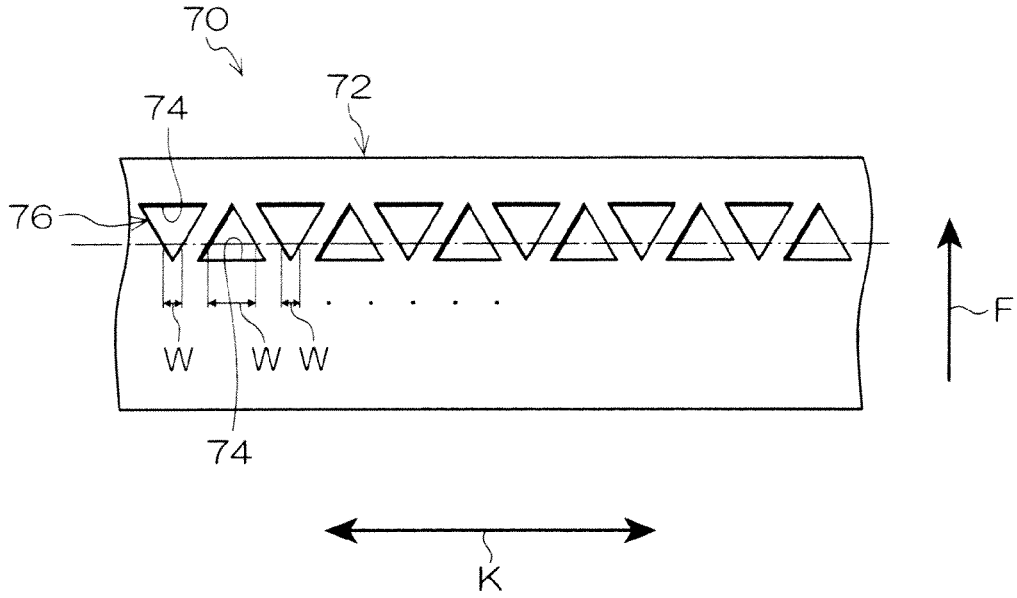
FIG. 5 is a front diagram showing relevant portions of a toner pool sheet of a cleaning device according to a second exemplary embodiment of the present invention.

As shown in FIG. 5, the cleaning device 70 of the second exemplary embodiment includes a toner pool sheet 72 in which plural openings 74 are disposed. The openings 74 are triangular, are disposed such that apexes of the openings 74 that are adjacent to each other oppositely face up and down, and form a row of the openings 76. It will be noted that the openings 74 in the row 76 of the present exemplary embodiment are provided on any line that intersects (is orthogonal to) the axis-of-rotation direction K of the photoreceptor drum 12 inside the toner image forming region and are disposed such that the sums of the widths (W) of the openings 74 become same on any line along the axis-of-rotation direction K of the photoreceptor drum 12 between the end portions (apexes and bottom edges) of the openings 74 on the upstream side and the downstream side in the rotation direction F of the photoreceptor drum 12. Further, it is preferable for the distance between the end portion of the row 76 on the downstream side in the rotational direction F and the corner portion 42E of the blade 42 (see Y1 in FIG. 2) to be 0.5 mm or greater and 8 mm or less.

Next, the action of the cleaning device 70 will be described. The openings 74 are disposed such that the sum of the widths of the openings 74 becomes substantially the same on any line along the axis-of-rotation direction K of the photoreceptor drum 12 between the end portions of the openings 74 on the upstream side and the downstream side in the rotational direction F of the photoreceptor drum. Thus, the residual toner T is effectively discharged from the toner pool TP, accordingly the amount of the residual toner T in the toner pool TP in the axis-of-rotation direction K becomes even closer to uniform. Thus, the amount of the external additive that escapes from the corner portion 42C of the blade 42 in the axis-of-rotation direction K becomes closer to uniform, the amount of the external additive that adheres to the charge roll 13 in the axis-of-rotation direction K also becomes closer to uniform. Additionally, the efficiency with which the residual toner T in the toner pool TP is refreshed improves.

Further, by disposing the triangular openings 74 such that the apexes of the openings 74 that are adjacent to each other oppositely face up and down as in the present exemplary embodiment, the amount of the residual toner T in the toner pool TP can be brought closer to uniform without lowering the rigidity of the toner pool sheet 72. Thus, the amount of the external additive that escapes from the blade 42 in the axis-of-rotation direction K can be brought closer to uniform.

Moreover, when the distance between the end portion of the row 76 on the downstream side in the rotational direction F and the corner portion 42E of the blade 42 is less than 0.5 mm, the residual toner T that has been cleaned by the blade 42 ends up being discharged quickly from the openings 74 before collecting in the toner pool TP, so the efficiency with which the residual toner T in the toner pool TP is refreshed drops. Further, when the distance in the rotational direction F between the end portion of the row 76 and the corner portion 42E of the blade 42 exceeds 8 mm, the openings 74 are too far away from the end portion 42T of the blade 42 where the flows of the residual toner T in the toner pool TP are strong, so the efficiency with which the residual toner T is discharged from the toner pool TP drops, and the amount of the residual toner T in the toner pool TP increases too much.

Figure 6:
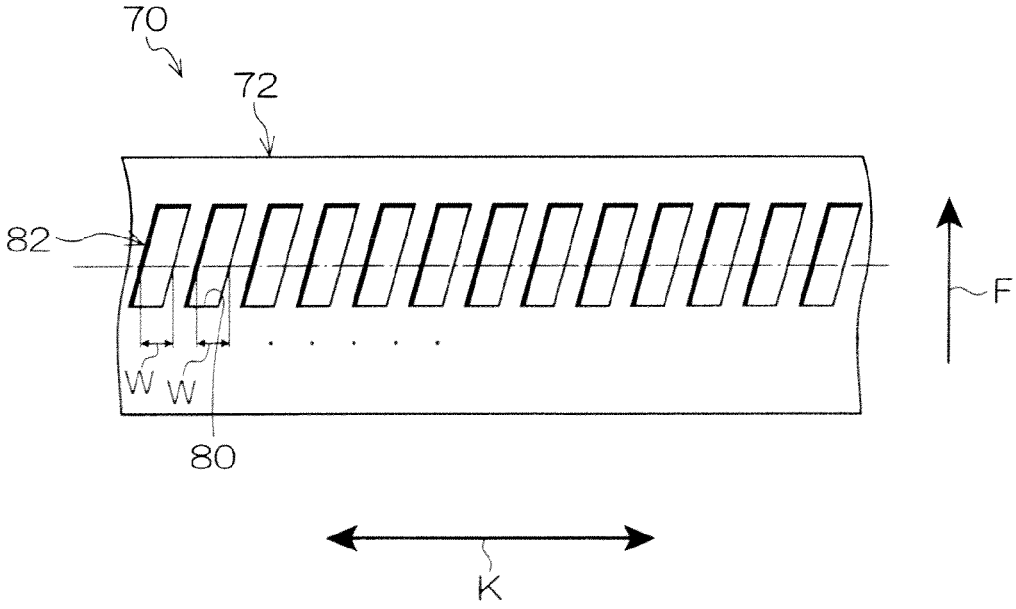
FIG. 6 is a front diagram showing relevant portions of a toner pool sheet of a modification of the cleaning device according to the second exemplary embodiment of the present invention.

In the cleaning device 70 of the present exemplary embodiment, the rows of the openings 76 that comprises the triangular openings 74 are formed in the toner pool sheet 72, but it is not necessary to be limited to this configuration. As shown in FIG. 6, parallelogram-shaped openings 80 may also be disposed along the axis-of-rotation direction K in the toner pool sheet 72 to form a row of the openings 82.

Third Exemplary Embodiment

Figure 7B:
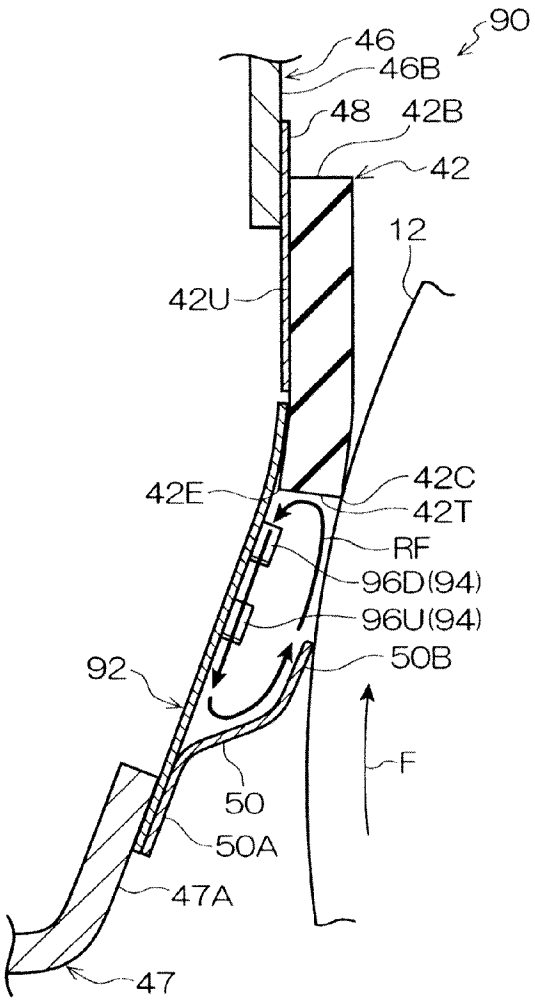
FIG. 7B is a partial cross-sectional diagram of FIG. 7A.

Next, a cleaning device 90 according to a third exemplary embodiment of the present invention will be described on the basis of FIG. 7A and FIG. 7B. It will be noted that the same reference numerals will be given to members that are the same as those in the first exemplary embodiment and that description of those same members will be omitted.

Figure 7A:
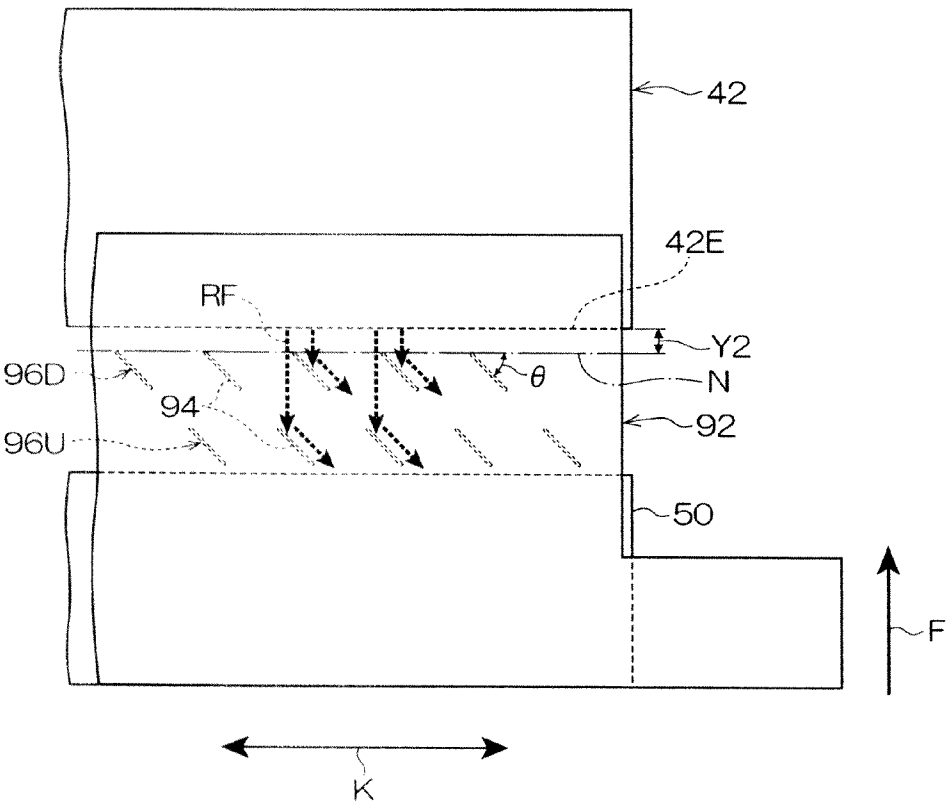
FIG. 7A is an enlarged front diagram showing slanted plates on a toner pool sheet of a cleaning device according to a third exemplary embodiment of the present invention.

As shown in FIG. 7A, the cleaning device 90 of the third exemplary embodiment includes a toner pool sheet 92 that is disposed with plural slanted walls 94 instead of the plural openings 54 that are disposed in the toner pool sheet 52 of the first exemplary embodiment. Further, in the present exemplary embodiment, when the amount of the residual toner T in the toner pool TP increases too much, the amount of the residual toner T in the toner pool TP is adjusted to an appropriate state because the contact portion where the rear surface 42U of the blade 42 and the toner pool sheet 92 contact each other is spaced and the residual toner T is discharged through this spaced portion into the inside of the housing 47.

The slanted walls 94 slant an angle θ (in the present exemplary embodiment, θ=45°) in the same direction with respect to the axis-of-rotation direction K and are disposed upright on the surface (the inner surface) contacting the toner pool TP of the toner pool sheet 92.

Further, the slanted walls 94 are disposed along the axis-of-rotation direction K and form plural slanted wall rows 96. It will be noted that, in the present exemplary embodiment, two of the slanted wall rows 96 are formed, the slanted wall row on the upstream side in the rotational direction F is represented by reference numeral 96U, and the slanted wall row on the downstream side in the rotational direction F is represented by reference numeral 96D. Further, as shown in FIG. 7B, the slanted walls 94 in the slanted wall row 96U are disposed on extension lines, in the slanting direction, of the slanted walls 94 in the slanted wall row 96D.

In the present exemplary embodiment, a distance Y2 between the corner portion 42E of the blade 42 and a straight line N (in FIG. 7A, indicated by a one-dotted chain line) that interconnects the end portions of the slanted walls 94 in the slanted wall row 96D that are on the downstream side in the rotational direction F is set to 0.5 mm.

Next, the action of the cleaning device 90 will be described. As shown in FIG. 7B, the flow RF of the residual toner T that flows through the toner pool TP in the opposite direction of the rotational direction F is changed to a flow in the axis-of-rotation direction K by the plural slanted walls 94. That is, the residual toner T in the toner pool TP flows in the axis-of-rotation direction K. Thus, accumulation of the residual toner T in the toner pool TP in the axis-of-rotation direction K is controlled, the amount of the residual toner T in the toner pool TP in the axis-of-rotation direction K is adjusted, and the pressure of the residual toner T that acts on the photoreceptor drum 12 becomes uniform along the axis-of-rotation direction K. As a result, the ability to remove products caused by electrical discharge from the photoreceptor drum 12 is ensured, the phenomenon of image deletion on the surface of the photoreceptor drum 12 is controlled, the occurrence of uneven wear in the photoreceptor drum 12 is controlled, and the lifespan of the photoreceptor drum 12 is prolonged.

Further, according to the cleaning device 90 of the present exemplary embodiment, with this simple configuration, the residual toner T in the toner pool TP flows in the axis-of-rotation direction K.

Here, because the flow of the residual toner T is strong in the vicinity of the end surface 42T of the tip portion of the blade 42 that cleans the residual toner T from the photoreceptor drum 12, the flow RF of the residual toner T is effectively changed to a flow in the axis-of-rotation direction K by bringing the end portions of the slanted walls 94 in the slanted wall row 96D that are on the upstream side in the rotational direction F closer to the end surface 42T. In particular, it is preferable for the slanted walls 94 to be disposed in positions where the distance Y2 is 0.5 mm or less.

It will be noted that, in the present exemplary embodiment, the angle θ is set to 45°, but it is not necessarily to be limited to this configuration. As shown in FIG. 7A, it suffices for the angle θ to be an angle that can change the flow RF of the residual toner T in the toner pool TP to a flow in the axis-of-rotation direction K.

Figure 8:
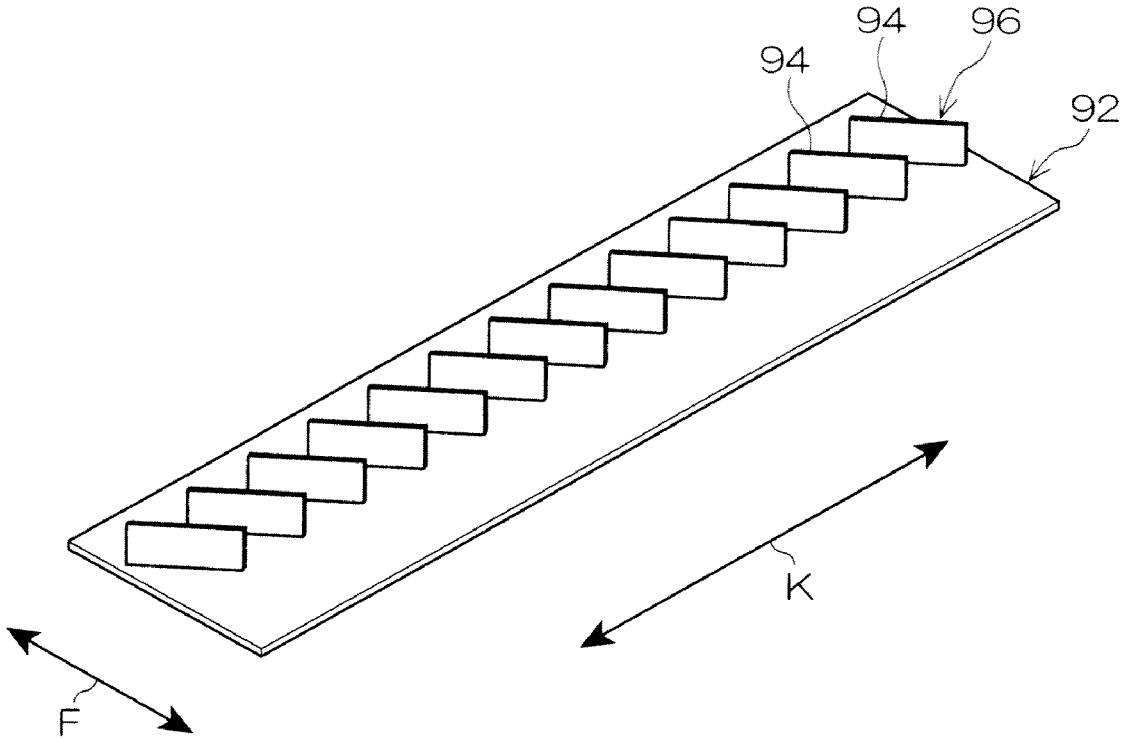
FIG. 8 is a perspective diagram showing slanted plates on a toner pool sheet of a modification of the cleaning device according to the third exemplary embodiment.

It will be noted that, in the present exemplary embodiment, the cleaning device 90 is disposed with two of the slanted wall rows 96 that are formed by the slanted walls 94, but it is not necessarily to be limited to this configuration. The number of the slanted wall rows may be one, as shown in FIG. 8, or three or more.

Fourth Exemplary Embodiment

Next, a cleaning device 100 according to a fourth exemplary embodiment of the present invention will be described on the basis of FIG. 9A and FIG. 9B. It will be noted that the same reference numerals will be given to members that are the same as those in the first exemplary embodiment and that description of those same members will be omitted.

Figure 9B:
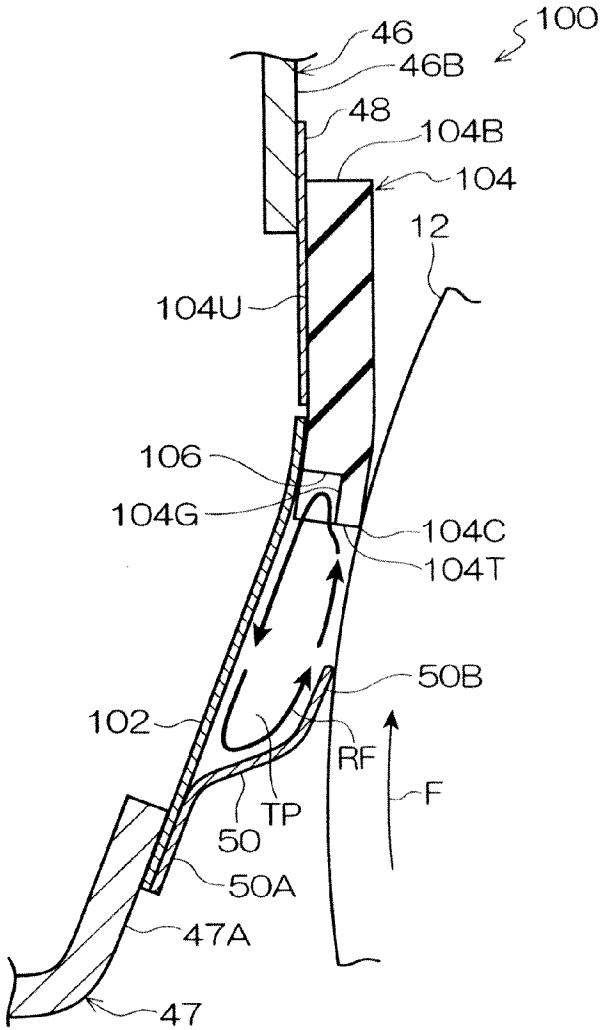
FIG. 9B is a partially enlarged cross-sectional diagram of the cleaning device disposed with the blade of FIG. 9A.

As shown in FIG. 9B, the cleaning device 100 of the fourth exemplary embodiment includes a toner pool sheet 102 in which the openings 54 are not formed as in the toner pool sheet 52 of the first exemplary embodiment.

Figure 9A:
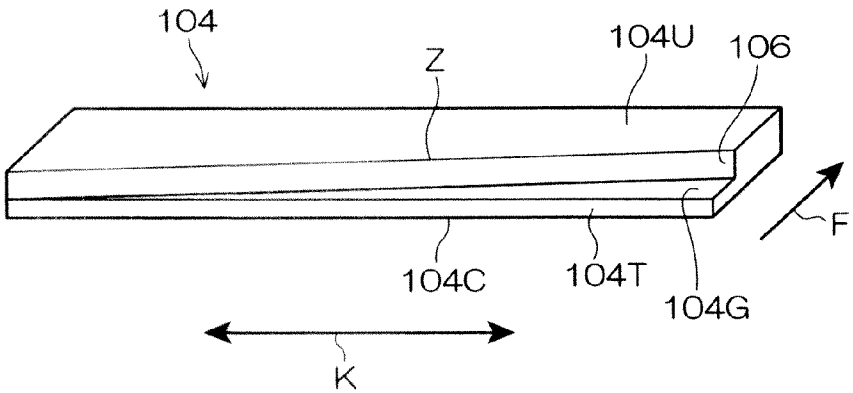
FIG. 9A is a perspective diagram of a blade of a cleaning device according to a fourth exemplary embodiment of the present invention.

As shown in FIG. 9A, a blade 104 of the present exemplary embodiment has a shape that is substantially the same as that of the blade 42 of the first exemplary embodiment, and each of the parts of the blade 104 will be corresponded to each of the parts of the blade 42. The base end portion of the blade 104 is represented by reference numeral 104B, the end surface of the blade 104 is represented by reference numeral 104T, the rear surface of the blade 104 is represented by reference numeral 104U, and the corner portion of the blade 104 that contacts the surface of the photoreceptor drum 12 is represented by reference numeral 104C.

In the present exemplary embodiment, when the amount of the residual toner T in the toner pool TP increases too much, the amount of the residual toner T in the toner pool TP is adjusted to an appropriate state because the contact portion where the rear surface 104U of the blade 104 and the toner pool sheet 102 contact each other is spaced and the residual toner T is discharged through this spaced portion into the inside of the housing 47.

As shown in FIG. 9A, the end surface 104T of the blade 104 is cut out in a triangular shape (that is, a triangular column shape) when seen from the rear surface side of the blade 104 such that the corner portion 104C is left. Because of this cutout, a slanted surface 106 that slants along the axis-of-rotation direction K and a side surface 104G that couples together the slanted surface 106 and the end surface 104T are formed in the tip portion of the blade 104. Further, the slanted surface 106 is continuous along the axis-of-rotation direction K. It will be noted that the borderline between the slanted surface 106 and the rear surface 104U is represented by the letter Z herebelow.

Next, the action of the cleaning device 100 will be described. Because the slanted surface 106 of the blade 104 (the borderline Z) slants along the axis-of-rotation direction K, the capacity, in the axis-of-rotation direction K, of the toner pool region that is defined by the toner pool sheet 102, the lower seal 50, the end surface 104T of the blade 104 and the surface of the photoreceptor drum 12 changes. Here, when the residual toner T that has been cleaned by the corner portion 104C of the blade 104 from the surface of the photoreceptor drum 12 flows into the toner pool TP, the residual toner T in the toner pool TP is pressed from the small capacity side to the large capacity side of the toner pool region. Thus, the residual toner T in the toner pool TP flows in the axis-of-rotation direction K. That is, the flow RF of the residual toner T in the toner pool TP in the opposite direction of the rotational direction F changes to a flow in the axis-of-rotation direction K. Thus, accumulation of the residual toner T in the toner pool TP in the axis-of-rotation direction K is controlled, the amount of the residual toner T in the toner pool TP in the axis-of-rotation direction K is adjusted, and the pressure of the residual toner T that acts on the photoreceptor drum 12 becomes uniform along the axis-of-rotation direction K. As a result, the ability to remove products caused by electrical discharge from the photoreceptor drum 12 is ensured, the phenomenon of image deletion on the surface of the photoreceptor drum 12 is controlled, the occurrence of uneven wear in the photoreceptor drum 12 is controlled, and the lifespan of the photoreceptor drum 12 is prolonged.

Further, according to the cleaning device 100 of the present exemplary embodiment, with this simple configuration, the residual toner T in the toner pool TP flows in the axis-of-rotation direction K.

Further, because the borderline Z is continuous in the axis-of-rotation direction K, a flow of the residual toner T in the toner pool TP in the axis-of-rotation direction K is imparted without interruption in the middle, so accumulation of the residual toner T in the toner pool TP in the axis-of-rotation direction K is effectively controlled.

Figure 10B:
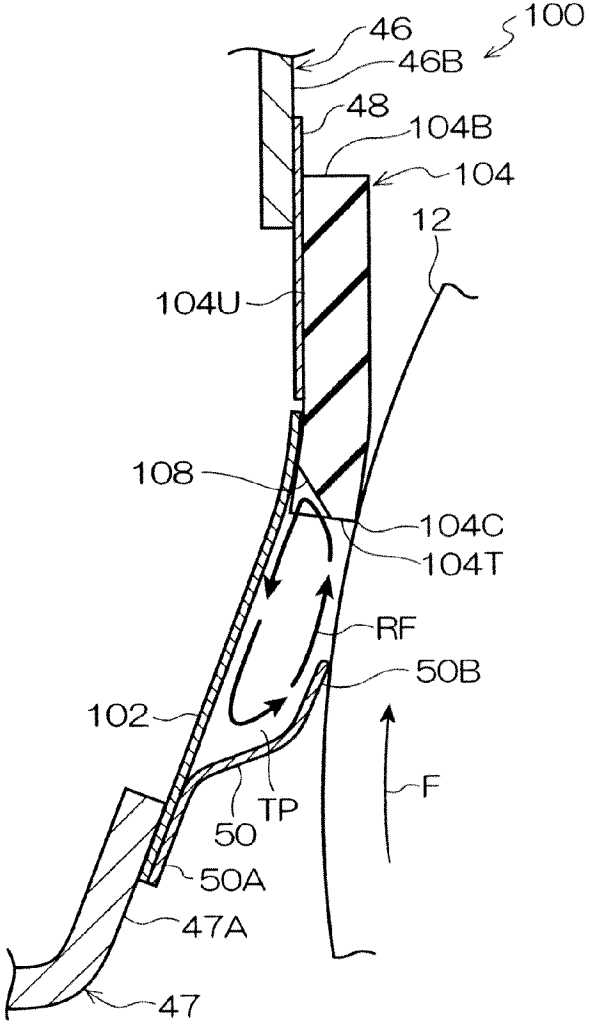
FIG. 10B is a partially enlarged cross-sectional diagram of the cleaning device disposed with the blade of FIG. 10A.
Figure 10A:
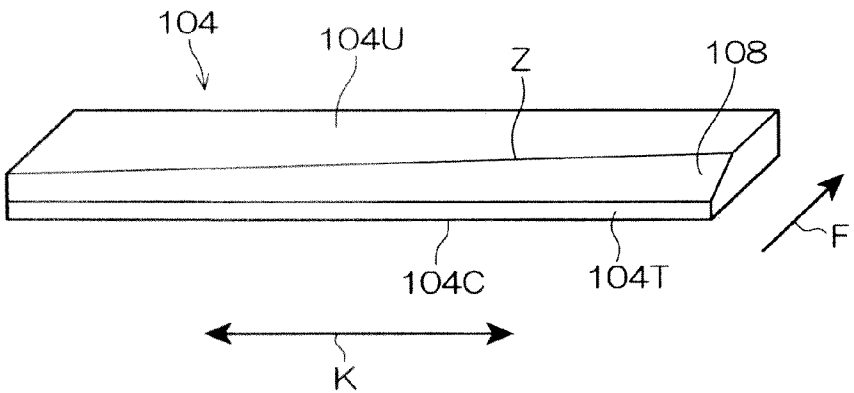
FIG. 10A is a perspective diagram of a blade of a modification of the cleaning device according to the fourth exemplary embodiment of the present invention.

In the present exemplary embodiment, the end surface 104T of the blade 104 is cut out to form the slanted surface 106 and the side surface 104G, but it is not necessary to be limited to this configuration. As shown in FIG. 10A and FIG. 10B, the cleaning device 100 may also be configured such that, rather than forming the side surface 104G, the end surface 104T is cut out such that a slanted surface 108 that slants along the axis-of-rotation direction K and also slants along the thickness direction of the blade 104 is formed. In this case there is less of a drop in the rigidity of the tip portion of the blade 104 resulting from the end surface 104T being cut out than when the slanted surface 106 and the side surface 106G are formed in the blade 104.

Figure 11:
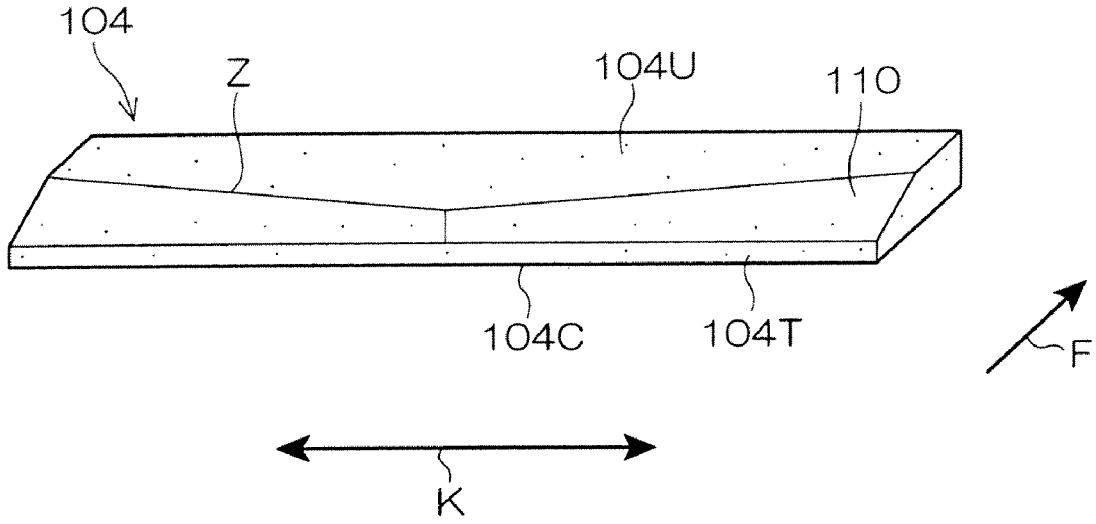
FIG. 11 is a perspective diagram of a blade of a modification of the cleaning device according to the fourth exemplary embodiment of the present invention.
Figure 12:
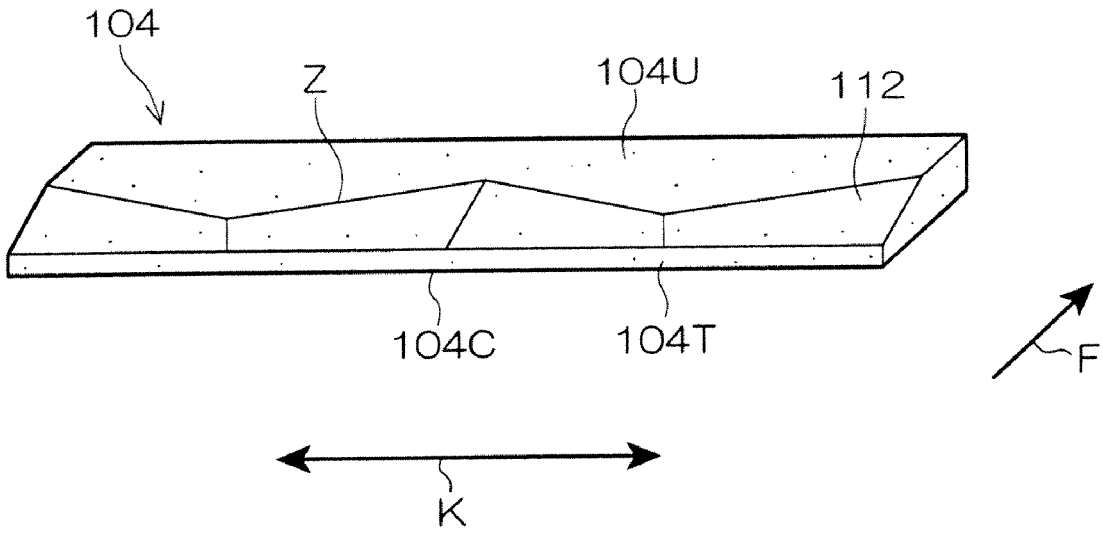
FIG. 12 is a perspective diagram of a blade of a comparative example.

Further, in the present exemplary embodiment, the cleaning device 100 is configured such that the slanted surface 108 (the borderline Z) is continuous straight along the axis-of-rotation direction K, but it is not necessary for the present invention to be limited to this configuration. As shown in FIG. 11, the blade 104 may also be configured such that the borderline Z slants with respect to the axis-of-rotation direction K toward both outer sides of the blade 104 from the vicinity of the center of the blade 104 in the axis-of-rotation direction K. However, when, as shown in FIG. 12, a slanted surface 112 is formed in the end surface 104T of the blade 104 such that the borderline Z includes two or more portions that are not continuous straight along the axis-of-rotation direction K, this promotes accumulation of the residual toner T in the toner pool TP, so it is not preferable for the borderline Z to have two or more portions that are not continuous straight. It will be noted that accumulation of the residual toner T in the toner pool TP is eliminated by disposing a discharging portion (e.g., openings or the like) for discharging the residual toner T in the part of the toner pool sheet 102 that corresponds to a portion where the residual toner T in the toner pool TP accumulates.

Incidentally, by cutting out the end surface 104T of the blade 104 as in the present exemplary embodiment, the rigidity of the tip portion of the blade 104 may drop, the pressing force of the corner portion 104C with respect to the photoreceptor drum 12 becomes nonuniform, and the ability of the blade 104 to sufficiently clean the residual toner T cannot be ensured. In this case, the rigidity of the tip portion of the blade 104 can be compensated by adjusting the shape of the blade plate 48 to bring the pressing force of the corner portion 104C of the tip portion with respect to the photoreceptor drum 12 closer to uniform in the axis-of-rotation direction K The details of this will be described below.

Figure 13A:
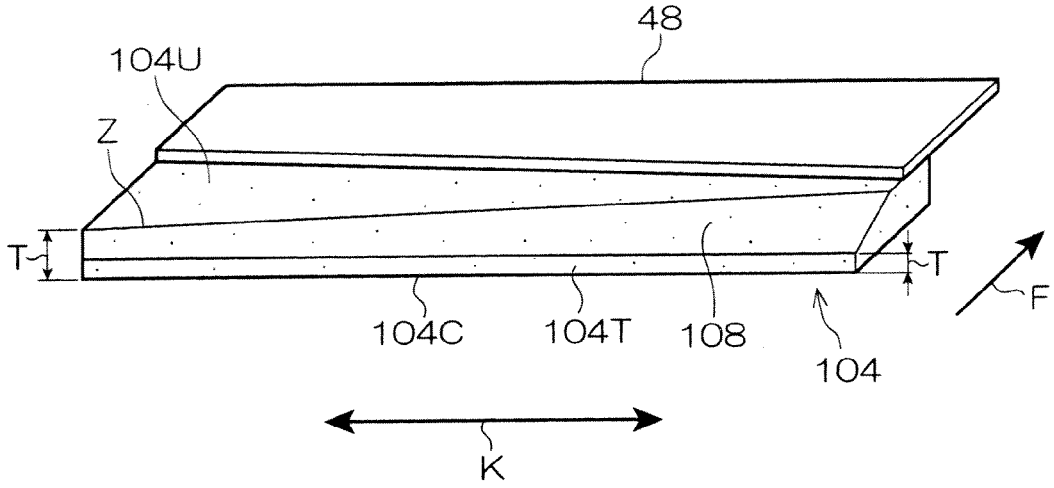
FIG. 13A is a perspective diagram showing a state where a blade plate is fixed to the blade of a modification of the cleaning device according to the fourth exemplary embodiment of the present invention.
Figure 13B:
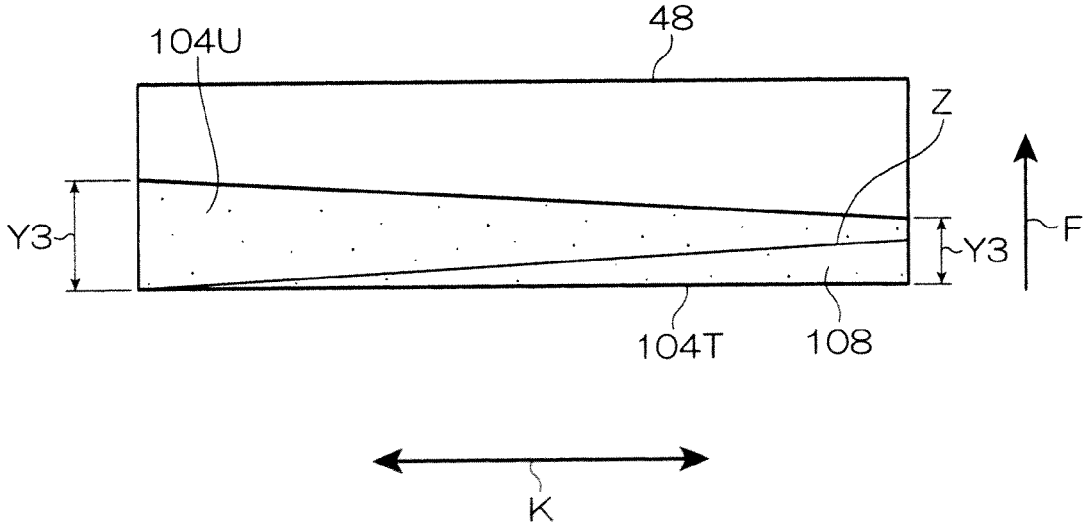
FIG. 13B is a plan diagram showing the blade of FIG. 13A as seen from above.

The blade plate 48 is a member that is capable of adjusting the pressing force with which the corner portion 104C presses against the surface of the photoreceptor drum 12. When a cutout is formed in the end surface 104T of the blade 104 as in the present exemplary embodiment, the rigidity of the tip portion of the blade 104 becomes vary (differs) in the axis-of-rotation direction K, so it is preferable to adjust the pressing force of the blade plate 48 in the axis-of-rotation direction K in response to this difference. For example, as an example to bring the pressing force to be closer to uniform in the axis-of-rotation direction K of the corner portion 104C that includes the aforementioned slanted surface 108 with respect to the surface of the photoreceptor drum 12, the blade plate 48 may be configured such that the shape of the one end portion thereof is formed as shown in FIG. 13A and FIG. 13B. The pressing force of the blade 104 in the axis-of-rotation direction K can be brought closer to uniform by adjusting the shape of the one end side of the blade plate 48 such that a distance Y3 between the end surface 104T of the blade 104 and the one end of the blade plate 48 is reduced in proportion to the reduction in the thickness T of the tip portion of the blade 104.

Figure 14A:
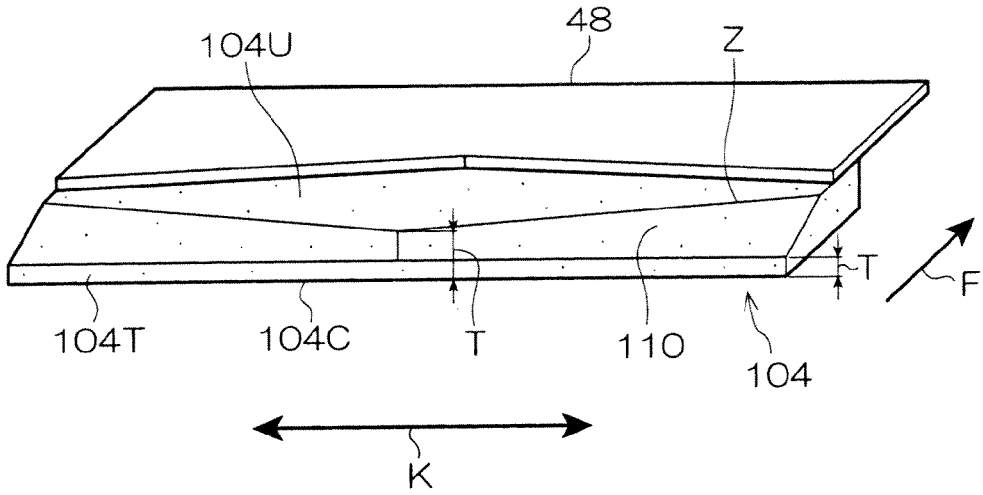
FIG. 14A is a perspective diagram showing a state where the blade plate is fixed to the blade of the modification of the cleaning device according to the fourth exemplary embodiment of the present invention.
Figure 14B:
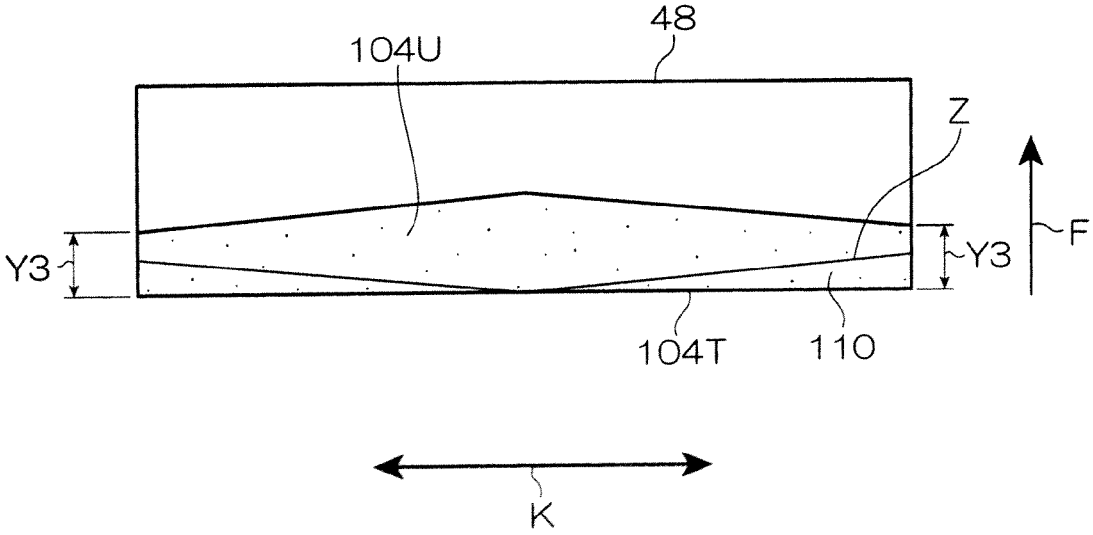
FIG. 14B is a plan diagram showing the blade of FIG. 14A as seen from above.

Further, as another example, in the case of the blade 104 that includes a slanted surface 110 shown in FIG. 11, the blade plate 48 may be configured such that the shape of the one end portion of the blade plate 48 is formed as shown in FIG. 14A and FIG. 14B. By making the thickness of both end sides of the tip portion of the blade 104 in the axis-of-rotation direction K thinner than the thickness of the center portion, the residual toner T flows from the center portion to both end sides. In a case that the distance Y3 is same, the pressing force at the center portion becomes stronger than at both end sides in the tip portion of the blade 104, and wear (film thinning) of the photoreceptor drum 12 also progress at corresponding center portion of thereof early. Thus, by forming the shape of the blade 48 in which the distance Y3 is reduced more toward both end sides than the center portion, the pressing force of the blade 104 is adjusted, the pressing force of the blade 104 can be brought closer to uniform in the axis-of-rotation direction K, and wear of the photoreceptor drum 12 can be made to progress substantially uniformly in the axis-of-rotation direction K.

Fifth Exemplary Embodiment

Next, a cleaning device 120 according to a fifth exemplary embodiment of the present invention will be described on the basis of FIG. 15. It will be noted that the same reference numerals will be given to members that are the same as those in the first exemplary embodiment and that description of those same members will be omitted.

Figure 15:
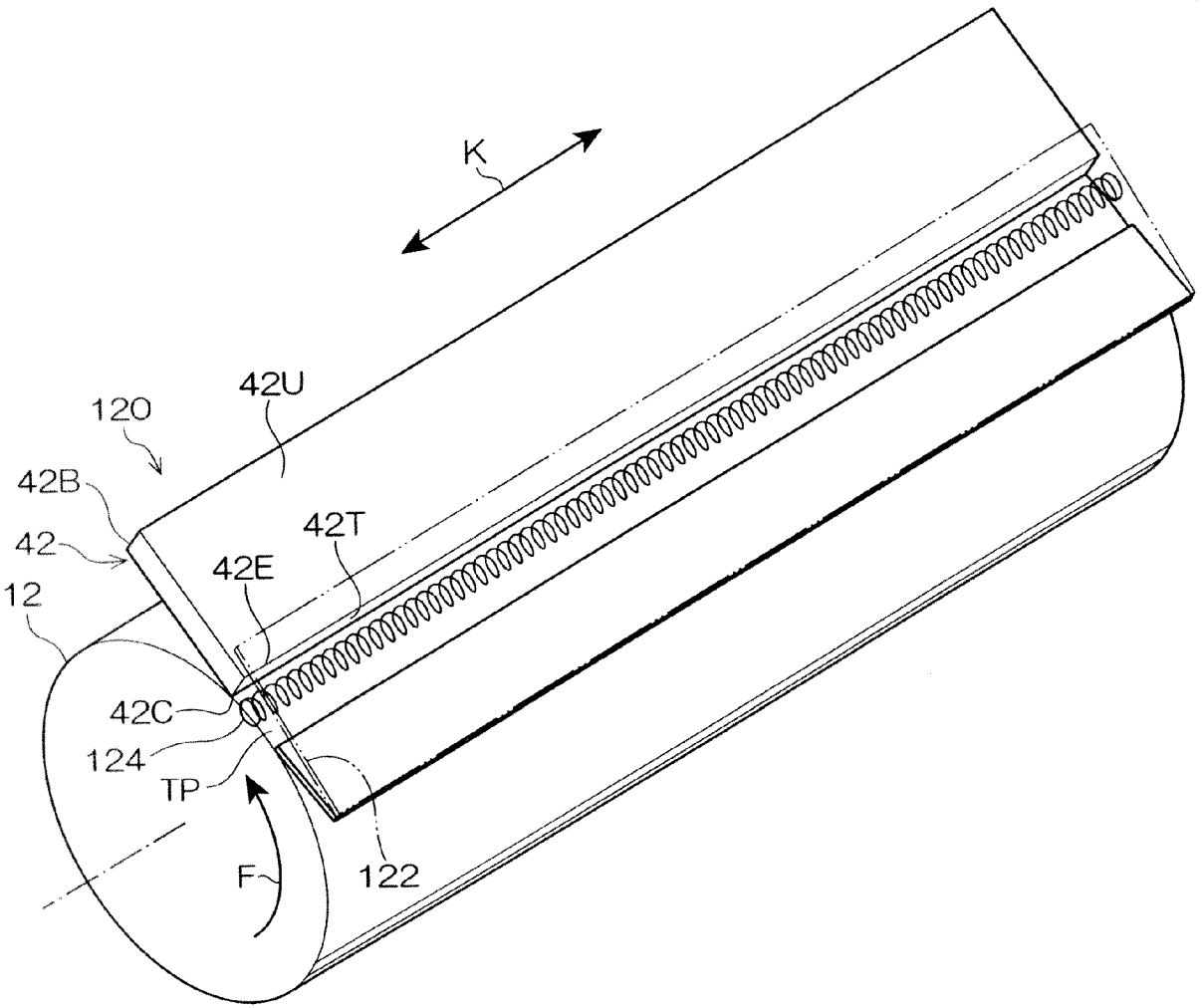
FIG. 15 is a perspective diagram of relevant portions of a cleaning device according to a fifth exemplary embodiment of the present invention.

As shown in FIG. 15, the cleaning device 120 of the fifth exemplary embodiment includes a toner pool sheet 122 in which the openings 54 are not formed as in the toner pool sheet 52 of the first exemplary embodiment. Further, in the present exemplary embodiment, when the amount of the residual toner T in the toner pool TP increases too much, the amount of the residual toner T in the toner pool TP is adjusted to an appropriate state because the contact portion where the rear surface 42U of the blade 42 and the toner pool sheet 122 contact each other is spaced and the residual toner T is discharged through this spaced portion into the inside of the housing 47.

A spiral member 124 that extends in the axis-of-rotation direction K is disposed in the toner pool TP. In the present exemplary embodiment, the spiral member 124 is a coil spring, and engaging portions (not shown) that are disposed on both axial direction end portions of the coil spring are engaged with engaged portions (not shown) that are disposed on both inner wall surfaces of the housing 47 in the axis-of-rotation direction K.

Next, the action of the cleaning device 120 will be described. The flow (RF) of the residual toner T that flows through the toner pool TP in the opposite direction of the rotational direction F is changed to a flow in the axis-of-rotation direction K by the spiral member 124. That is, the residual toner T in the toner pool TP flows in the axis-of-rotation direction K. Thus, accumulation of the residual toner T in the toner pool TP in the axis-of-rotation direction K is controlled, the amount of the residual toner T in the toner pool TP in the axis-of-rotation direction K is adjusted, and the pressure of the residual toner T that acts on the photoreceptor drum 12 becomes uniform along the axis-of-rotation direction K. As a result, the ability to remove products caused by electrical discharge from the photoreceptor drum 12 is ensured, the phenomenon of image deletion on the surface of the photoreceptor drum 12 is controlled, the occurrence of uneven wear in the photoreceptor drum 12 is controlled, and the lifespan of the photoreceptor drum 12 is prolonged.

Further, according to the cleaning device 120 of the present exemplary embodiment, with this simple configuration, the residual toner T in the toner pool TP flows in the axis-of-direction direction K.

Further, it is preferable for the spiral member 124 to be disposed close to the end surface 42T of the blade 42. Specifically, it is preferable for the spiral member 42 to be disposed in a position where the distance (see Y2 in FIG. 7A) between the upper end portion of the spiral member 124 in the rotational direction F and the corner portion 42C of the blade 42 is within 0.5 mm. This is because the flow of the residual toner T is strong in the vicinity of the end surface 42T of the tip portion of the blade 42 that cleans the residual toner T from the photoreceptor drum 12 accordingly, the flow of the residual toner T in the opposite direction of the rotational direction F can be changed to a flow in the axis-of-rotation direction K by bringing the upper end portion of the spiral member 124 in the rotational direction F closer to the end surface 104T.

In the present exemplary embodiment, the spiral member 124 is configured by a coil spring, but it is not necessary to limit this configuration. The spiral member may also be configured by a shaft body that is disposed with a spiral groove in its outer peripheral surface.

In the first to fifth exemplary embodiments, the cleaning device 33 for the intermediate transfer belt is used to remove transfer residual toner from the intermediate transfer belt 30, but the present invention is not limited to this configuration and may also be configured to use the cleaning devices of the first to fifth exemplary embodiments that pertain to the present invention instead of the cleaning device 33.

Further, the effects of the present invention are exhibited even more when the cleaning devices of the first to fifth exemplary embodiments are used in image forming apparatus that print gray images in units of several hundred sheets. In such image forming apparatus, it is easy for differences in the amount of the residual toner T become large in the toner pool TP in the axis-of-rotation direction K.

Moreover, the effects of the present invention are exhibited even more when the cleaning devices of the first to fifth exemplary embodiments are used in image forming apparatus that use polymerized toner. This is because the diameters of the toner particles of polymerized toner are close to uniform, so there is the potential for the polymerized toner particles to be condensed (packing) when they are kept over a long period in the toner pool TP, but by using the cleaning devices of the first to fifth exemplary embodiments, accumulation of the residual toner T in the toner pool TP in the axis-of-rotation direction K is controlled, so packing is prevented.

Further still, the effects of the present invention are exhibited even more when the cleaning devices of the first to fifth exemplary embodiments are used in image forming apparatus that use low-wear photoreceptor drums. This is because, since a protective layer that is hard to be ground down is disposed on the surface of a low-wear photoreceptor drum. This may cause removal of products caused by electrical discharge with a blade is not necessarily sufficient, the residual toner T amount in the toner pool TP and the amount of the external additive that escapes are vary. By using the cleaning devices of the first to fifth exemplary embodiments, the amount of the residual toner T in the toner pool TP in the axis-of-rotation direction K is brought closer to uniform, so these problems are eliminated.

Additionally, the cleaning devices of the third to fifth exemplary embodiments are configured such that openings are not formed in the toner pool sheet, but it is not necessary for the present invention to be limited to this configuration, and openings for discharging the residual toner T may also be formed in the toner pool sheet. In this case, even when the residual toner T accumulates at the non-open portions of the toner pool sheet, the residual toner T in the toner pool TP flows in the axis-of-rotation direction K, so accumulation of the residual toner T in the toner pool TP in the axis-of-rotation direction K is controlled.

Implementing the present invention have been described above by way of exemplary embodiments, but these exemplary embodiments are only examples and can be various altered and implemented within a range that does not depart from the gist of the invention. Further, it goes without saying that the scope of the rights of the present invention is not limited to these exemplary embodiments.

Test Examples

Next, test examples in which the present embodiment is implemented will be described.

Figure 16:
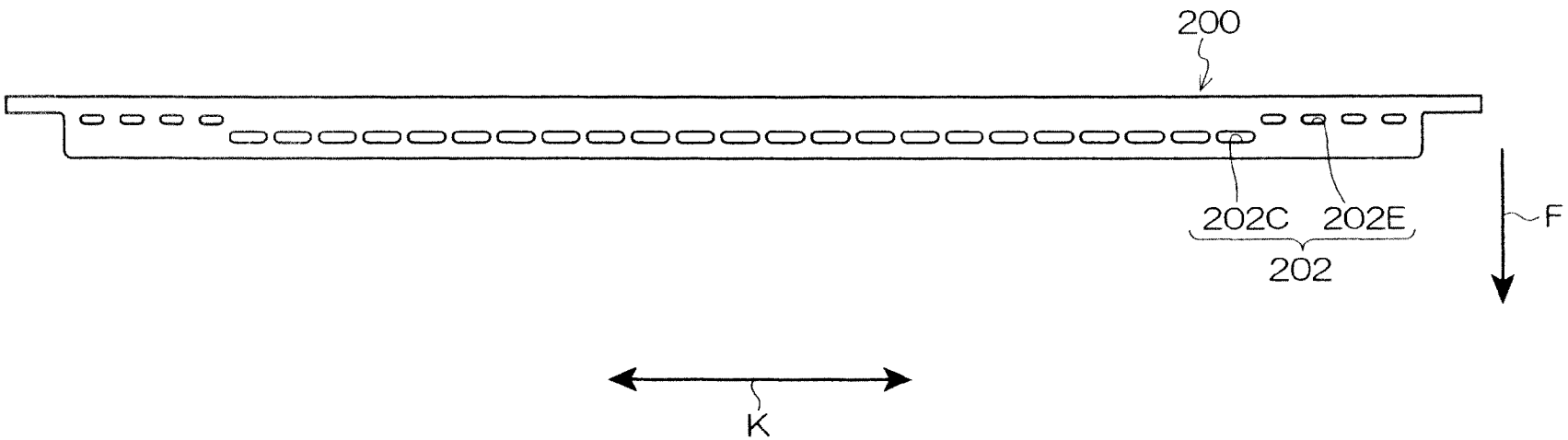
FIG. 16 is a front diagram showing a blade that is used in a cleaning device according to comparative example 1.

In the tests, an image forming apparatus disposed with the cleaning device according to the first exemplary embodiment of the present invention (below, "example 1") and an image forming apparatus disposed with a cleaning device of a comparative example (below, "comparative example") are used. The cleaning device of the comparative example is disposed with a blade 200 shown in FIG. 16, and the blade 200 is disposed with plural openings 202 in its longitudinal direction (the axis-of-rotation direction of the photoreceptor drum). It will be noted that openings 202C on the center side in the longitudinal direction of the blade 200 are set such that their opening area is larger than that of openings 202E on both end sides and that the positions of the openings 202C in the width direction (direction of arrow F) are offset with respect to the positions of the openings 202E.

Figure 17:
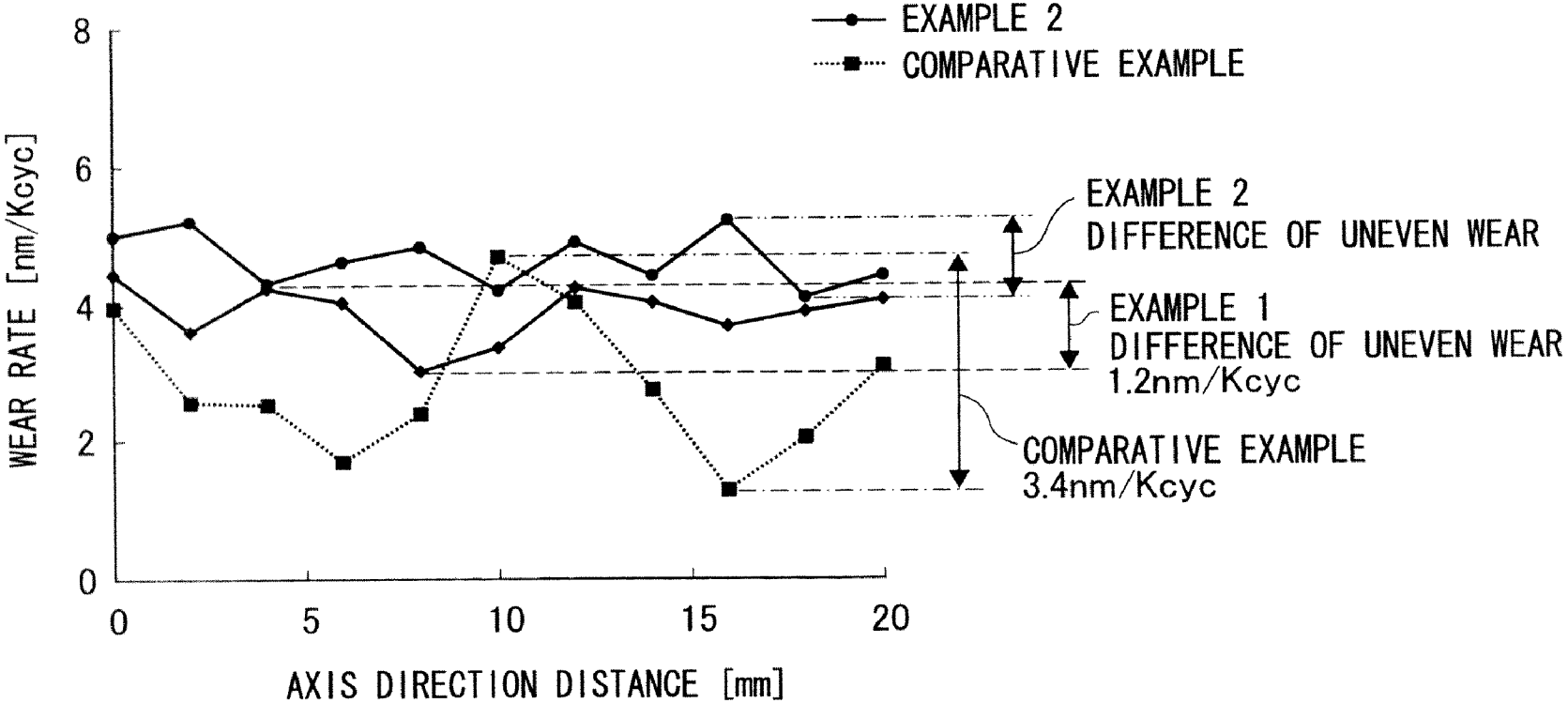
FIG. 17 is a graph showing differences in the amount of wear of image carriers in an axis-of-rotation direction of the image carriers.

Print experiments with these image forming apparatus are implemented 1000 times (their photoreceptor drums are rotated 1000 times), wear occurring in the photoreceptor drums is measured, differences in the wear (uneven wear) are evaluated, and the results are shown in FIG. 17. It will be noted that, in the present tests, an evaluation is also performed in regard to an image forming apparatus disposed with the cleaning device according to the third exemplary embodiment of the present invention (below, "example 2").

Next, print experiments with these image forming apparatus are implemented and evaluations of halftone images are performed. As the test conditions, the tests are performed under high temperature high humidity (environmental temperature of 25° C. and environmental humidity of 80% relative humidity) and low temperature low humidity (environmental temperature of 10° C. and environmental humidity of 20% relative humidity). The results were evaluated by "○", "Δ" and "×" and are shown in FIG. 18. It will be noted that "○" represents a level with no problems, "Δ" represents an acceptable level, and "×" represents an unacceptable level.

Figure 19:
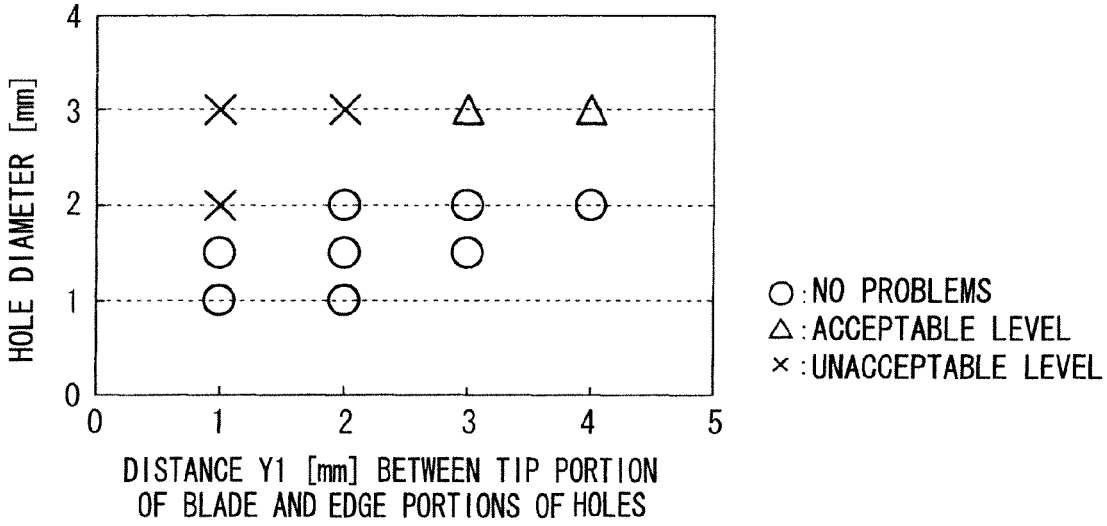
FIG. 19 is a graph showing occurrence statuses of image quality defects resulting from the relationship between the diameter of openings and the distance to edge portions of the openings from the tip portion of the blade.

Then, the image defect (deletion) level is evaluated using the image forming apparatus of example 1. The evaluation conditions are such that the image forming apparatus is left for 8 hours after running at 5 kpv (50,000 sheets) under a high temperature high humidity condition and a halftone image of an image density of 30% is sampled to evaluate the white spot level. With respect to this test condition, the hole diameter of example 1 and the distance (see Y1 in FIG. 2) from (the corner portion of) the tip portion of the blade to the upper end portions of the holes are changed. The evaluations results are shown in FIG. 19. It will be noted that "○" represents a level with no problems, "Δ" represents an acceptable level, and "×" represents an unacceptable level.

According to the results of the wear tests of the photoreceptor drums, as shown in FIG. 17, it will be understood that differences in the wear on the photoreceptor drum of each of example 1 and example 2 are small and superior to the comparative example. Further, according to the evaluation results of the halftone images, as shown in FIG. 18, in the comparative example, white spots occur in the halftone image under the high temperature high humidity condition, and under the low temperature low humidity condition, toner density unevenness resulting from abnormal charging occur. In contrast, all items of example 1 are of a level with no problems, so it will be understood that example 1 is superior to the comparative example. Moreover, according to the evaluation of the image defect level, as shown in FIG. 19, it will be understood that the amount of the residual toner in the toner pool is reduced when the hole diameter is made larger and that the ability to remove products caused by electrical discharge drops. In contrast, it becomes possible to make the hole diameter larger by increasing the distance between (the corner portion of) the tip portion of the blade and the edge portions of the holes thereby the amount of residual toner in the toner pool to be increased, The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning device comprising:

a cleaning blade that contacts an image carrier and cleaning residual toner remaining on the image carrier; and a toner pool forming member that is disposed on an upstream side of the cleaning blade in a rotational direction of the image carrier, collects the residual toner that has been cleaned by the cleaning blade, and forms a toner pool;

wherein the toner pool forming member configured to have a closed space at an upstream side in the rotational direction of the image carrier as from a normal line that extends from a contact region where the image carrier and the toner pool forming member contact each other, the residual toner is not discharged from the upstream side in the rotational direction as from the normal line.

2. The cleaning device of claim 1, wherein the residual toner in the toner pool is discharged to a housing which is provided at the opposite side to the image carrier with respect to the toner pool forming member, the toner pool forming member has a rear portion that is disposed to be adjacent to the housing and a front portion that is disposed to be adjacent to the image carrier, wherein the residual toner is discharged further to the downstream side in the rotational direction of the image carrier than the normal line.

3. The cleaning device of claim 2, wherein the rear portion of the toner pool forming member comprises a plurality of openings that discharge the residual toner, and the openings are arranged to overlap all regions of a toner image forming region of the image carrier in an axis-of-rotation direction of the image carrier, wherein the plurality of openings are provided at the downstream side in the rotational direction of the image carrier than the normal line.

4. The cleaning device of claim 3, wherein the plurality of openings form at least two rows of opening in the axis-of-rotation direction of the image carrier, and adjacent rows are mutually offset in the axis-of-rotation direction of the image carrier.

5. The cleaning device of claim 3, where in the openings are positioned along the axis-of-rotation direction of the image carrier.

6. The cleaning device of claim 5, wherein the plurality of openings are disposed such that the sums of the widths of the openings along the axis-of-rotation direction of the image carrier are the same.

7. A cleaning device comprising:

a cleaning blade that contacts an image carrier and cleaning residual toner remaining on the image carrier, a toner pool forming member that is disposed on an upstream side of the cleaning blade in a rotational direction of the image carrier, collects the residual toner that has been cleaned by the cleaning blade, and forms a toner pool;

a toner flow component that causes the residual toner in the toner pool to flow in the axis-of-rotation direction of the image carrier; and a toner discharging component that adjusts the amount of the residual toner.

8. The cleaning device of claim 7, wherein the toner flow component comprises a plurality of walls that slant in the same direction with respect to the axis-of-rotation direction of the image carrier and are disposed on an inner surface of the toner pool forming member along the axis-of-rotation direction of the image carrier.

9. The cleaning device of claim 7, wherein the toner flow component comprises a spiral member that is disposed in the toner pool and extends in the axis-of-rotation direction of the image carrier.

10. The cleaning device of claim 7, wherein the cleaning blade comprises a plate body that is positioned in the toner pool, the plate body having at an end surface thereof a corner portion that contacts the image carrier, and the plate body also having a slanted surface that slants along the axis-of-rotation direction of the image carrier.

11. The cleaning device of claim 10, wherein the slanted surface is continuous along the axis-of-rotation direction of the image carrier.

12. The cleaning device of claim 11, wherein a reinforcement plate that increases the rigidity of the plate body is joined to a rear surface of the plate body, the rear surface being on a side of the plate body that does not contact the image carrier.

13. The cleaning device of claim 7, wherein a plurality of openings that discharge the residual toner from the toner pool are disposed in the toner pool forming member along the axis-of-rotation direction of the image carrier.

14. An image forming apparatus comprising:

a toner image developing unit that forms a toner image on an image carrier;

a primary transfer unit that transfers the toner image on the image carrier to an intermediate transfer member;

a secondary transfer unit that transfers the toner image on the intermediate transfer member to a medium;

a fixing unit that fixes the toner image to the medium; and the cleaning device of claim 1.

15. An image forming apparatus comprising:

a toner image developing unit that forms a toner image on an image carrier;

a primary transfer unit that transfers the toner image on the image carrier to an intermediate transfer member;

a secondary transfer unit that transfers the toner image on the intermediate transfer member to a medium;

a fixing unit that fixes the toner image to the medium; and the cleaning device of claim 2.

16. An image forming apparatus comprising:

a toner image developing unit that forms a toner image on an image carrier;

a primary transfer unit that transfers the toner image on the image carrier to an intermediate transfer member;

a secondary transfer unit that transfers the toner image on the intermediate transfer member to a medium;

a fixing unit that fixes the toner image to the medium; and the cleaning device of claim 3.

17. An image forming apparatus comprising:

a toner image developing unit that forms a toner image on an image carrier;

a primary transfer unit that transfers the toner image on the image carrier to an intermediate transfer member;

a secondary transfer unit that transfers the toner image on the intermediate transfer member to a medium;

a fixing unit that fixes the toner image to the medium; and the cleaning device of claim 7.

18. The cleaning device of claim 2, wherein the rear portion of the toner pool forming member comprises a plurality of openings, and the plurality of openings are formed between a middle and a downstream end in a length of the rear portion in the rotational direction of the image carrier.

19. The cleaning device of claim 3, wherein the toner pool is formed up to an area where the plurality of the openings are formed.

20. The cleaning device of claim 3, wherein an amount of the residual toner in the toner pool is substantially uniform across the axis-of-rotation direction of the image carrier.

21. The cleaning device of claim 3, wherein a distance between an end portion of the openings at a downstream side in the rotational direction of the image carrier and a contact portion of the cleaning blade with the image carrier is from about 0.5mm to about 3mm.

* * * * *